United States Patent [19]

Tsuya et al.

[11] 4,257,830

[45] Mar. 24, 1981

[54] METHOD OF MANUFACTURING A THIN RIBBON OF MAGNETIC MATERIAL

[75] Inventors: Noboru Tsuya, 1-38, Kashiwagi 2-Chome, Sendai, Japan; Kenichi Arai, Sendai, Japan

[73] Assignee: Noboru Tsuya, Sendai, Japan

[21] Appl. No.: 974,504

[22] Filed: Dec. 29, 1978

[30] Foreign Application Priority Data

Dec. 30, 1977 [JP] Japan ..... 52-158017
Sep. 19, 1978 [JP] Japan ..... 53-114846

[51] Int. Cl.[3] ..... H01F 1/04

[52] U.S. Cl. ..... 148/112; 148/31.55; 164/87; 164/423; 164/429; 335/296; 360/125

[58] Field of Search ..... 148/111, 112, 31.55; 164/423, 429, 487; 335/297, 296; 360/125, 126, 127

[56] References Cited

U.S. PATENT DOCUMENTS

| | | | |
|---|---|---|---|
| 1,756,196 | 4/1930 | Hopkins et al. | 164/87 |
| 1,867,818 | 7/1932 | Freeland | 148/111 |
| 2,364,642 | 12/1944 | Miller et al. | 175/366 |
| 2,956,023 | 10/1960 | Fredrick et al. | 252/62.3 |
| 3,241,009 | 3/1966 | Dewald et al. | 317/234 |
| 3,381,739 | 5/1968 | Hart | 164/64 |
| 3,445,554 | 5/1969 | Jerome | 264/56 |
| 3,545,967 | 12/1970 | Mandal | 75/134 |
| 3,663,767 | 5/1972 | Shimotori et al. | 360/127 |
| 3,748,728 | 7/1973 | Watson | 29/599 |
| 3,837,827 | 9/1974 | Carruthers et al. | 65/30 |
| 3,896,203 | 7/1975 | Maringer et al. | 264/165 |
| 3,902,930 | 9/1975 | Sata et al. | 148/112 |
| 4,000,014 | 12/1976 | Winter | 148/11.5 R |
| 4,049,522 | 9/1977 | Ainslie et al. | 360/126 |
| 4,065,330 | 12/1977 | Matsumoto et al. | 148/31.55 |
| 4,079,430 | 3/1978 | Fujishima et al. | 360/126 |
| 4,135,218 | 1/1979 | Nakamura et al. | 360/127 |
| 4,146,391 | 3/1979 | Inoue et al. | 148/31.55 |

FOREIGN PATENT DOCUMENTS

| | | |
|---|---|---|
| 51-138517 | 11/1976 | Japan . |
| 52-123314 | 10/1977 | Japan . |
| 53-18422 | 2/1978 | Japan . |

*Primary Examiner*—L. Dewayne Rutledge
*Assistant Examiner*—John P. Sheehan
*Attorney, Agent, or Firm*—Fleit & Jacobson

[57] ABSTRACT

A method of manufacturing a thin ribbon of magnetic material having a high permeability and excellent flexibility and workability comprising the combination of steps of melting a magnetic material consisting of essentially of by weight 4–7% of aluminum, 8–11% of silicon and the remainder substantially iron and inevitable impurities at a temperature of between a melting point and a temperature not exceeding 300° C. from the melting point, and necessary subingredient of less than 7%, ejecting thus obtained melt under a pressure of 0.01–1.5 atm. through a nozzle onto a moving or rotating cooling substrate, cooling super-rapidly the melt on the rotating surface of said cooling substrate at a cooling rate of $10^3$ -$10^6$° C./sec so as to have a high initial permeability of more than $10^4$, a low coercive force of less than 0.10 Oe and an excellent flexibility, forming a thin ribbon having a compact and fine grain size structure substantially without existing of the ordered lattice, and annealing thus obtained thin ribbon at a temperature of between 600° to 1,000° C. for 1 minute to 5 hours, more preferably 1 to 100 minutes so as to obtain a columnar crystal structure by promoting the growth of crystal grain size.

20 Claims, 53 Drawing Figures x 600 x 600 x 600 x 600

(1) $Fe_{85.35}$ $Si_{9.37}$ Al
(2) $Fe_{85.12}$ $Si_{9.50}$ Al
(3) $Fe_{84.9}$ $Si_{9.62}$ Al
(4) $Fe_{84.55}$ $Si_{9.8}$ Al
(5) $Fe_{84.75}$ $Si_{9.7}$ Al

METHOD OF MANUFACTURING A THIN RIBBON OF MAGNETIC MATERIAL

BACKGROUND OF THE INVENTION

The invention relates to a method of manufacturing a thin ribbon of magnetic material having a high permeability, excellent flexibility and workability, and consisting essentially of by weight 4–7% of aluminum, 8–11% of silicon and the remainder substantially iron and inevitable impurities and having a compact fine grain crystalline structure without existing substantially an ordered lattice, a thin ribbon thereof, and a magnetic recording and reproducing head made of this thin ribbon.

Since Dr. Hakaru Masumoto has firstly introduced a magnetic alloy consisting of 84.9% of iron, 9.5% of silicon and 5.6% of aluminum in 1936, this magnetic alloy has widely been known as "Sendust" (Trade name). The alloy consisting of this composition ratio shows remarkable soft magnetic characteristics, has almost no magnetostriction nor magnetic anisotropy, and as a result, said alloy has an initial permeability $\mu o$ of $10^4$, coercive force Hc of 0.05 Oe and specific resistance of about 80 $\mu\Omega$ cm, which are excellent characteristics as a soft magnetic material. This alloy is brittle and not flexible and cannot be formed into a thin sheet by rolling, forging or swaging, so that it was used either bulk-like body in a low frequency region or its use is limited to a dust core in a high frequency region.

There was demerit that a fine cracking and chipping inevitably occurred during working and cutting of the ingot to a thin plate of core of the magnetic recording and reproducing head.

At present, this alloy is worthy of merit in magnetic recording technique and recognized as one of excellent magnetic recording and reproducing head materials, because the alloy has the excellent mechanical wear resistance against sliding motion of a magnetic tape, the soft magnetic properties as described above and the high saturation magnetic flux density. Therefore, a plurality of head cores are directly cut out from an ingot of this alloy, even though this alloy is mechanically very hard, about more than 500 of Vickers hardness, and very brittle. If this alloy can be formed into a thin ribbon or thin sheet, it will become more easily workable than the case of handling a bulk thereof and the alloy can be utilized as not only a core material of a magnetic recording and reproducing head but also a wide range usage such as several kinds of induction materials.

An object of the present invention is to provide a method of manufacturing a thin ribbon of magnetic material having a high permeability consisting essentially of by weight 4–7% of aluminum, 8–11% of silicon and the remainder substantially iron and inevitable impurities as a main ingredient and at least one element of less than 7% by weight in total selected from the group consisting of V, Nb, Ta, Cr, Mo, W, Cu, Ti, Mn, Ge, Zr, Sb, Sn, Be, B, Bi, Pb, Y and the rare earth element comprising, melting said magnetic material at a suitable temperature between a melting point and a temperature not exceeding 300° C. from the melting point, ejecting the obtained melt onto the cooling substrate having a good wettability suitable under an ejecting pressure of 0.01–1.5 atm. corresponding to the viscosity of the melt, cooling super-rapidly the melt at suitable cooling rate of $10^{3°}$–$10^{6°}$ C./sec, and forming a thin ribbon having a compact and fine grain structure and an excellent flexibility and workability.

The other object of the present invention is to provide a method of annealing thus obtained thin ribbon of magnetic material to realize a high permeability without spoiling an excellent flexibility and workability so as to ensure the grain growth and to produce a columnar crystalline structure.

It is known in the Japanese Official Gazette of Patent Laid-Open 138,517/1976 (Kudo et al) a method of producing a thin ribbon by ejecting a melt of magnetic material having a high permeability onto a moving or rotating cooling substrate with high speed such as drum, disc, twin roll or belt conveyor and cooling super-rapidly the melt directly on the surface of the cooling substrate.

This is a method of manufacturing a thin ribbon of magnetic material which comprises melting the magnetic material having Sendust composition, ejecting the melt through nozzle to high speed moving or rotating cooling substrate and super-rapid cooling the melt at a cooling rate of $10^{5°}$ C./sec and forming an amorphous thin ribbon.

It was proposed by the above authors that the thus obtained thin ribbon according to the prior art is durable to apply a cold rolling of several ten %, and annealed by heat treatment after forming to a final configuration of product so as to recover the high permeability of more than 5,000 $\mu o$ and low coercive force Hc of less than 0.03 by ensuring the grain growth. in the present inventors theoretical analysis, it is very difficult to form an amorphous thin ribbon by super-rapidly cooling the melt having the composition of magnetic material consisting of aluminum 4–7%, silicon 8–11% and the remainder iron, except that the super-rapid cooling at a cooling rate of more than $10^{7°}$ C./sec is necessary to obtain an amorphous thin ribbon in the Sendust composition.

Upon the analytical study, the present inventors found that the super-rapid cooling should be applied at a rate of less than $10^{6°}$ C./sec but more than $10^{3°}$ C./sec so as to obtain a compact, fine crystalline columnar structure perpendicular to ribbon surface distributed without the ordered lattice.

After repeat testing, the inventor found that it is very important to select a suitable measure from the following conditions.

(1) The cooling speed of the melt is preferably selected from $10^{3°}$–$10^{6°}$ C./sec.

(2) The melting temperature of the melt should be determined to a suitable temperature not exceeding 300° C. from the melting point considering with respect to the diameter of nozzle hole and the ejecting pressure.

(3) The viscosity of the melt should be adjusted to a preferable range of $5.5\times10^{-2}\sim3\times10^{-2}$ dyne·sec/cm$^2$ by determining a suitable melting temperature of the melt.

(4) The ejecting pressure of the melt should be selected from a suitable range of 0.01–1.5 atm.

(5) The cooling substrate should be selected from among substrates having good wettability for the melt.

(6) The cooling substrate is preferably held at a temperature between room temperature and 400° C. under vacuum or inert gas atmosphere.

(7) The moving or rotating speed may be preferably adjusted at a high speed so as to adjust the cooling speed of $10^{3°}$–$10^{6°}$ C./sec and obtain a thin ribbon having a compact fine crystalline structure by super-rapid cooling on the moving or rotating surface of a cooling substrate during adhering on the surface of the cooling substrate.

It is very important to select the material of cooling substrate depending upon magnetic material to be used by taking into account a wettability between the melt of magnetic material and the cooling substrate. The wettability is mainly determined by surface tensions of the melt and the substrate. The viscosity of the melt is selected from a suitable range to ensure the good characteristics of spreading the melt without bounding upon the cooling substrate when the melt is ejected through the nozzle. When the melt temperature is more than 300° C. above the melting point, the melt might spread over the cooling surface of the substrate so that the ribbon wafer becomes too thin and some times a greatly notched ribbon similar to a rattan blind might be produced, while when the melt temperature is too low, the jet flow of the melt is not spread and is separated into a number of small particles having irregular configuration. According to the invention, it is preferable to select such a viscosity of the melt that the edges of the melt are made in contact with the substrate at an angle from 10° to 170° with respect to the substrate surface. For this purpose, a temperature of the melt should be selected within the range from the melting point to 300° C. above the melting point, particularly 100° C. to 150° C. above the melting point.

It is also very important that the melt of magnetic material should be instantaneously super-rapidly cooled on the cooling substrate at a suitable cooling rate of at least 1,000° C./sec, preferably 1,000 to 1,000,000° C./sec by taking account of wettability between the melt of magnetic material and the cooling substrate.

According to the invention, it has been found that the pressure under which the melt is ejected through the nozzle should be within the range of 0.01–1.5 atm.

If the ejecting pressure of the melt is too high, a melt would be scattered as the mist or fine particle having irregular configuration or the resulted ribbon becomes a greatly notched ribbon similar to a rattan blind.

The ejection of the melt is preferably effected in a vacuum but it may be carried out in an inert gas or reducing gas atmosphere. Even in the latter case, it is preferable to reduce the pressure.

The invention will be explained in more detail as follows.

Said thin ribbon can be manufactured by said method in the composition of the thin ribbon according to the invention which is substantially the same as that of Sendust alloy, i.e., Al-Si-Fe series base alloy or Sendust series alloy containing suitable subingredient. Therefore, the composition of the thin ribbon according to the present invention is determined to contain by weight 4–7% of aluminum, 8–11% of silicon and the remainder essentially iron and inevitable impurities. However, all elements contained in the conventional Sendust alloy other than the above elements as inhibitor can be contained less than 0.1 wt% in total. Further, less than 60% of iron can be substituted for Ni and/or Co for improving various characteristics in accordance with the purpose, so that nickel and cobalt can be contained in raw material, if necessary.

If these elements are contained more than 0.1 wt% in conventional Sendust alloy, the ribbon manufactured by similar method as prior arts (Japanese Official Gazette of Patent Laid-Open 138,517/1976, 123,314/1977, and 18,422/1978) are brittle and less flexible than that of the ribbon manufactured by the present art disclosed above.

When the contents of aluminum and silicon are out of said range, an initial permeability $\mu o$ of more than $10^4$ and a coercive force Hc of less than 0.1 Oe cannot be obtained, and it is necessary that the contents of aluminum and silicon are determined to 4–7% and 8–11%, respectively.

In the thin ribbon of magnetic material according to the invention, the subingredient added with the main component of 4–7% of aluminum, 8–11% of silicon and the remainder iron may be selected from at least one element of the group consisting of vanadium, niobium, tantalum, chromium, molybdenum, tungsten, copper, titanium, manganese, germanium, zirconium, antimony, tin, beryllium, boron, bismuth, lead, yttrium and rare earth elements in a range of less than 7% in total.

It is observed by our study that the necessary condition for obtaining a thin ribbon having compact fine crystalline structure by super-rapid cooling on high speed moving or rotating cooling substrate the melt having said Sendust composition is to eject the melt by reducing the said inevitable impurities to less than 0.1% in total of carbon, nitrogen, oxygen and sulphur preliminary. The reason is as follows. If the impurities such as carbon, nitrogen, oxygen and sulphur are included in the Sendust alloy in total of less than 0.1%, these impurities have a very low solidability limit, so these impurities cannot be solved in the solid solution of the melt during the super-rapid cooling and these impurities are distributed as a fine precipitation in the matrix of the rapidly cooled thin ribbon. This precipitation is the cause of not only a decrease of bending strength but also the decrease of the magnetic properties. Further, the admixture of oxide in raw magnetic material, particularly dross coupled with fine particle contained in an alloy melt before starting super-rapid cooling becomes a cause of a breakage due to bending in a cooled state of a thin ribbon. Therefore, according to the present invention, a melting and a solidification of melt materials are repeated once or more than once for floating and separating dross or slag on the surface of the melt. It is advantageous to eject the melt having oxide concentration of less than 0.1%.

The material of a moving or rotating cooling substrate or the material of a moving surface at least contact to the ejected melt may be at least one element selected from the group consisting of copper, copper alloy such as beryllium copper alloy, aluminum, aluminum alloy, titanium alloy, steel, alloy steel such as stainless steel, fused silica, fused alumina, etc. by taking account of the composition of the melt and wettability. The melt having the composition of a thin ribbon of magnetic material according to the present invention has better wettability in case of using the cooling substrate made of steel, alloy steel and aluminum or aluminum alloy than that of a cooling substrate made of copper or copper alloy and it is available to super-rapid cooling the melt in a short time. Under the above reason, it is very important that the material of a cooling substrate should be selected by considering the wettability between the melt and the cooling substrate.

It is very important in manufacturing a thin ribbon of magnetic material according to the present invention that raw material should be maintained to high purity, each condition for manufacturing a thin ribbon is suitably selected with respect to material, structure of nozzle and cooling substrate, more specially it is also important in using a cooling substrate to select a mutual pressure applied to the rolls and the roll space and speed and temperature of the rolls to suitable conditions, whereby size of the thus obtained thin ribbon becomes large and high flexibility can be obtained, and also apparent specific gravity considerably becomes close to the real specific gravity and high size precision can be maintained. In this connection, if a temperature of the cooling substrate is maintained uniformly too low in the whole region of producing the thin ribbon in the widthwise direction, the high size precision of thin ribbon cannot be obtained. To avoid this fault, a temperature of twin rolls in the portion of producing the thin ribbon should be maintained up to 400° C. from room temperature by heating. It is a very important factor to elevate magnetic saturation density.

For instance, in case of using a disc as a cooling substrate, if the condition of producing a thin ribbon is rather close to ideal condition, the apparent specific gravity of the thin ribbon becomes low, so that high saturated magnetic density cannot be obtained.

When the temperature of the melt becomes too high, the viscosity is remarkably decreased. When these melts having low viscosity are ejected through nozzle, the melt has a tendency to be in a spherical form by the surface tension. If the ejecting speed is too high, the melt cannot be formed into a continuous jet flow and would be scattered as fine particles by the collision with the air or a turbulent flow in the melt. Each particle is close to the spherical form, and a scattered particle of a large size receives various forces during moving in the air and is greatly modified from the spherical form and rescattered, or particles are agglomerated with each other in some cases. In such a process, if the temperature of said melt is too high, the continuous steady jet flow of the melt cannot be obtained, so that the thus obtained thin ribbon has several unevennesses and its magnetic property is deteriorated.

The other fault in the case of the melting temperature being too high causes two phenomena when the jet flow of melt is stricken to the surface of cooling substrate. In the outset, if the temperature of the melt is too high from the melting point in the collision to the cooling substrate, the jet flow of melt will be repelled on the surface of cooling substrate and scattered as fine particle, the thin ribbon cannot be formed. However, the temperature of cooling substrate is maintained a suitable temperature between room temperature and 400° C., the repellent is not induced, when the viscosity is maintained in a suitable range of $5.5\times10^{-2}\sim3\times10^{-2}$ dyne-sec/cm$^2$, whereby the melt forms a thin ribbon. In the second, when the melt is super-rapidly cooled on the surface of cooling substrate, the free surface of jet flow of melt is not parallel to the moving surface of the cooling substrate. The surface wave is induced by the collision of the jet flow of the melt to the cooling substrate, and unevenness in the thickness of the thin ribbon occurs partially. If the temperature of jet flow of melt is suitably adjusted, the wettability in the contact surface between the melt and cooling substrate is suitably adjusted to fit the surface tension, whereby the surface wave is not resulted, and this is called crystal dumping state. If it is in crystal dumping state, a thin ribbon having a very high size precision can be obtained. If the melt is super-rapidly cooled in the state of oscillating at a high frequency surface wave, and the contact angle between the jet flow of melt and the moving surface of cooling substrate is excessively more than 90° , the solidified thin ribbon becomes like a rattan blind.

It is very important that a flexible thin ribbon is durable to more large pressure to breakage limit than that of brittle thin ribbon. This means that the great working force can be applied to thin ribbon in working.

It is important that the high mass productionability of thin ribbon for using magnetic head can be expected.

It is further observed that the high separation ability for lamination in building magnetic head apparatus can be expected, and it is a significant value that the manufacturing price is reduced.

It is very important that when two thin ribbons are pressed for lamination, a high size precision cannot be expected by brittle thin ribbon. It is worthwhile for actual use not to obtain a flexible thin ribbon. It is necessary to use adhesive agent or aluminum solder to adhere thin ribbons.

In this case, the thermal outer pressure is applied to laminated thin ribbon, the high flexibility of thin ribbon is utmostly requested to manufacture magnetic head means, etc.

It has a high significant industrial value as the flexibility of thin ribbon is high.

BRIEF EXPLANATION OF THE DRAWINGS

The present invention will be explained in more detail referring to the accompanying drawings.

Detailed Explanation of the Preferred Embodiments

The method of manufacturing a thin ribbon of magnetic material having high permeability according to the invention is explained in detail based on the testing result.

Figure 1:
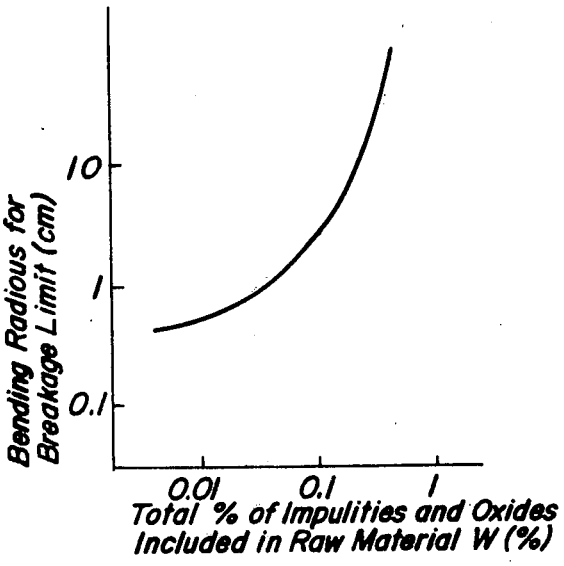
FIG. 1 shows a relation between a total amount of impurities and an oxide content (wt.%) in raw material for manufacturing a Sendust alloy thin ribbon and a radius of curvature (cm) to a breakage of the thin ribbon.

In the present invention, a relation between the contents of impurities and oxide in the thin ribbon and the radius of curvature to a breakage limit due to bending is experimented and the result is shown in FIG. 1. FIG. 1 shows that the lower the contents of oxide and impurity containing oxide, the smaller the radius of curvature to a breakage limit in the bending test and the larger the bending resistance increases. Thus, if the concentration of impurities and oxide is reduced, the bending strength can be increased more than twice. Since the said impurities such as carbon, sulphur, nitrogen and the like which have a very small solid-solubility limit to the alloy, it has a very bad influence on the resulting characteristics of a thin ribbon of magnetic material.

It is very important to reduce the contents of impurities of the melt to less than 0.1% in total before ejecting the melt so as to have excellent flexibility in the thin ribbon.

Figure 2:
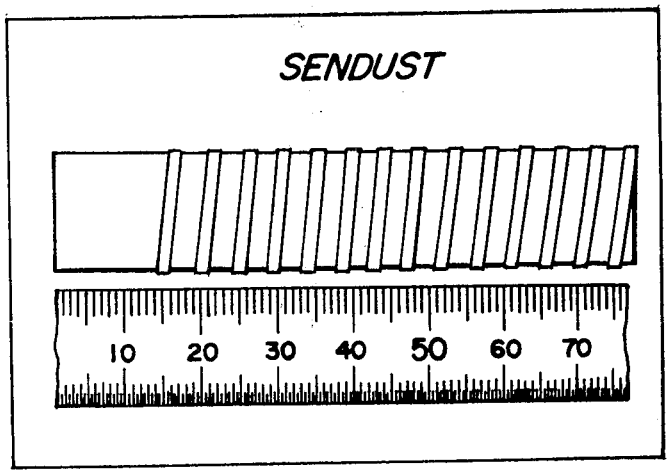
FIG. 2 illustrate a reference drawing showing a flexibility of thin ribbon that thin ribbon can wind up around a bar having 10 cm diameter.

The thin ribbon according to the present invention has high flexibility and can be coiled around a bar having a diameter of less than 10 cm as shown in FIG 2. This flexibility is a characteristic feature which has never been expected in the conventional known Sendust alloy or a magnetic alloy with high permeability improved from Sendust alloy having hard abrasion resistance.

The thin ribbon according to the present invention consists of a column-like crystalline structure composed of compactly agglomerated fine crystal grains of several $\mu m$ on an average grain size within the range of 1 $\mu m$ to about 100 $\mu m$ and aligned perpendicular to the ribbon surface. It is observed that the amorphous thin ribbon of Sendust alloy disclosed in the prior art is greatly different from the thin ribbon having said compact fine crystalline structure on an average grain size of 1 $\mu m$ to about 100 $\mu m$ according to the present invention in crystalline structure and flexibility. If the bulk of Sendust alloy according to the prior art is ground or cut, a loss due to slipping of the thin ribbon is caused but the thin ribbon according to the present invention does not cause such loss or breakage.

The magnetic properties of the thin ribbon of magnetic material according to the present invention are more improved by annealing at a temperature of between 600° to 1,000° C. from about 1 minute to 5 hours, whereby a column-like crystal structure having a grain size of from about 0.01 to 10 mm with the ordered lattice is obtained by promoting the grain growth of the fine and compact structure of thin ribbon having an average grain size from about 1 to 100 $\mu m$. The effect of the heat treatment was observed by the following test result.

Figure 3A:
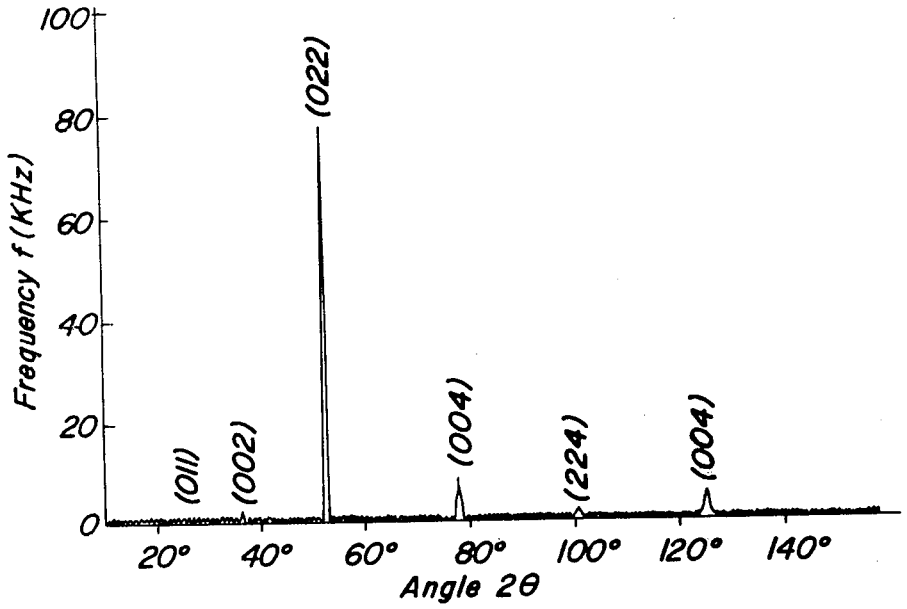
FIGS. 3(*a*) and 3(*b*) show X-ray refraction patterns of a super-rapidly cooled and solidified thin ribbon and a heat-treated thin ribbon according to the present invention, respectively.
Figure 3B:
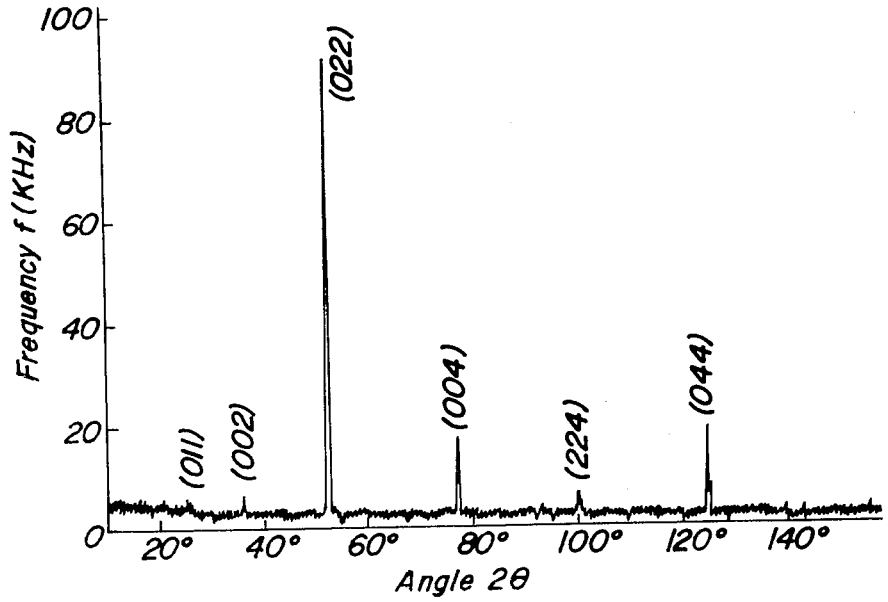

FIGS. 3(*a*) and 3(*b*) illustrate an X-ray diffraction pattern by using X-ray of (Co-K$\alpha$) of a thin ribbon which is super-rapidly cooled on a moving surface substrate according to the present invention and a heat-treated thin ribbon which is heat-treated for about 30 minutes at 835° C. after forming a thin ribbon in the final configuration. FIGS. 3(*a*) and 3(*b*) show the width of X-ray diffraction pattern of a thin ribbon which is super-rapidly cooled on moving substrate and not heat-treated thin ribbon (as shown in FIG. 3(*b*)).

Figure 4A:
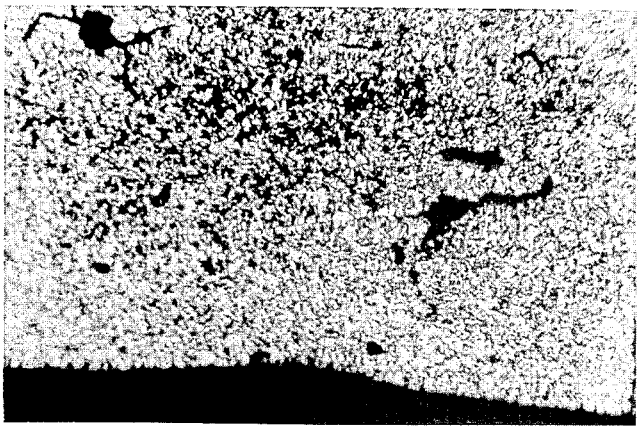
FIGS. 4(*a*) and 4(*b*) are microscopic photographs showing structures of the surface and the cross-sectional surface of the rapidly cooled and solidified thin ribbon according to the present invention.
Figure 4B:
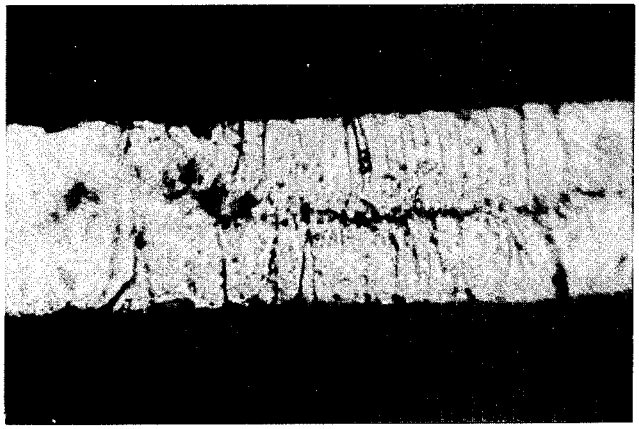

It can be observed from this phenomenon that the residual internal stress in a non heat-treated thin ribbon is tempered by heat-treatment and the crystal grain size becomes gross. The super crystalline lattice line was not observed in any heat treated thin ribbon. The parameter of crystalline lattice is determined to 2.85 A from the data of this measurement. This value is quite similar to that of the bulk of Sendust core. The density of thin ribbon was determined to be 6.43 g/cm$^3$ by the measured value of size and weight. This value is rather similar to be 6.9 g/cm$^3$ of the ideal density of bulk of Sendust alloy. The microscopic observation was made in a thin ribbon of magnetic material consisting of Fe 8.25%, Si 9.37% and Al 5.38% according to the present invention before and after heat-treatment. The surface of thin ribbon was mechanically polished as pretreatment, and applied etching by dipping into the mixed solution of 20 cc of water and 1 cc of nitric acid for 10 minutes. FIGS. 4(*a*) and 4(*b*) illustrate microscopic photographs showing the surface and the section of non-heat-treated thin ribbon.

Figure 5A:
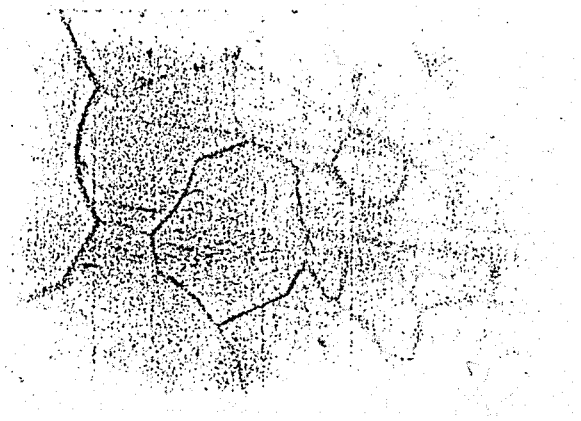
FIGS. 5(*a*) and 5(*b*) are microscopic photographs showing textures of the surface and the cross-sectional surface of the heat-treated thin ribbon according to the present invention.
Figure 5B:
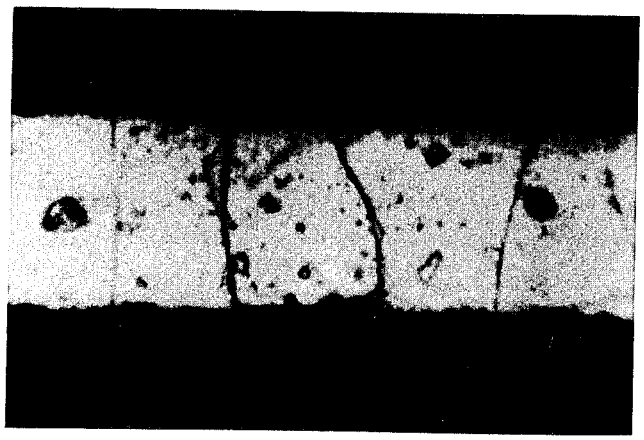

FIGS. 5(*a*) and 5(*b*) illustrate microscopic photographs of the surface and the section of thin ribbons heat-treated at 835° C. for 30 minutes. The compact and fine grain crystalline structure was observed in the non-heat-treated thin ribbon and the average grain size was 4 μm in diameter in the center portion of the section of thin ribbon. The crystal grain becomes gross to about 30 μm in diameter in the surface of thin ribbon and the column-like crystalline structure was formed in the perpendicular direction to the surface of thin ribbon.

It is observed by Audie spectrum that the insulating layer of $Al_2O_3$ is in the region of about 100 A in the depth on the surface of these thin ribbons. It is also observed that this insulating layer is quite effective to insulate between thin ribbons in manufacturing the core of magnetic recording and reproducing head.

Figure 6:
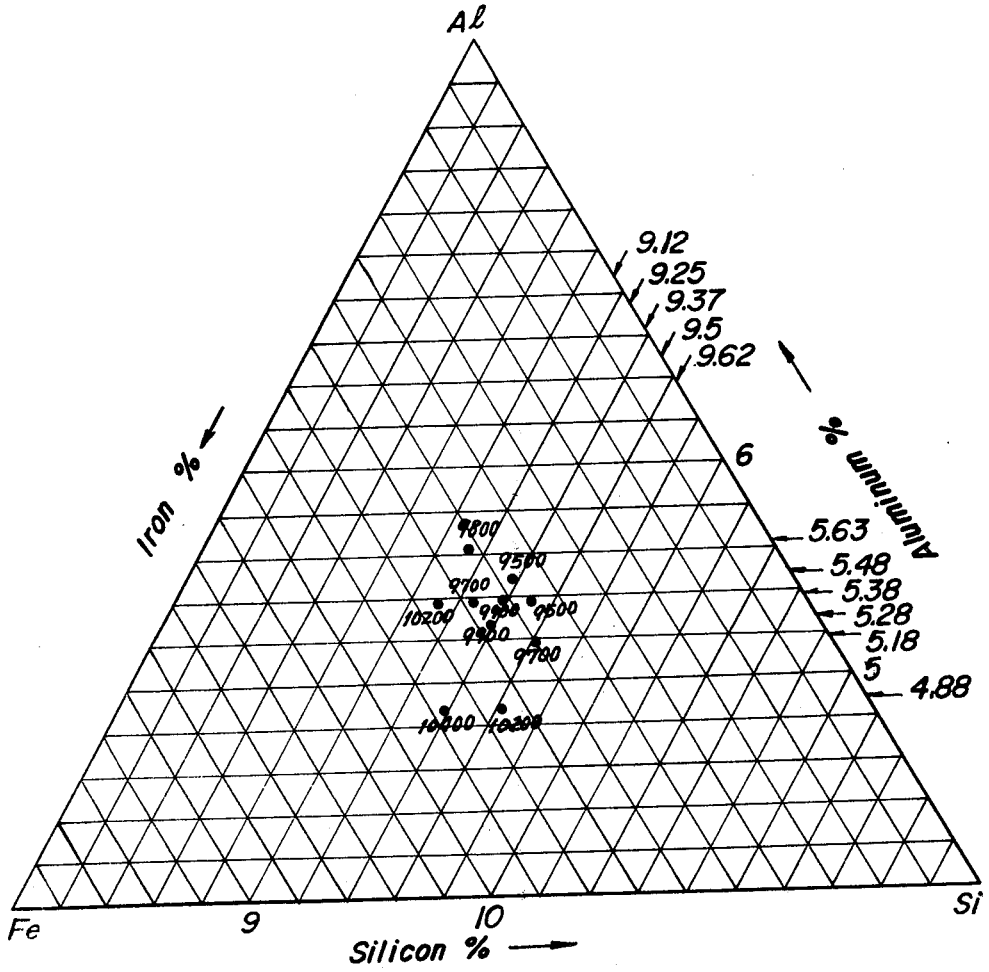
FIG. 6 shows a three dimensional diagram illustrating a relation between a saturated magnetic flux density and a composition of the thin ribbon according to the present invention.

FIG. 6 illustrates the data obtained from a thin ribbon according to the present invention by measuring its magnetic saturation flux density at room temperature under a magnetic field of 3,000 Oe. As can be seen from FIG. 6, the magnetic saturation flux density was increased the greater density of iron and 96,000 gauss in the sample having a composition of Fe 85.13%, Si 9.37% and Al 5.80%. This value is about the same as that of Sendust alloy in the prior art.

The present inventors further found that the soft magnetic properties of a thin ribbon according to the present invention can be improved by heat-treatment of a thin ribbon having a composition of Fe 85.13%, Si 9.37% and Al 5.50% according to the present invention which is heat-treated in vacuum for 1–300 min. with an infrared ray heating apparatus.

Figure 7:
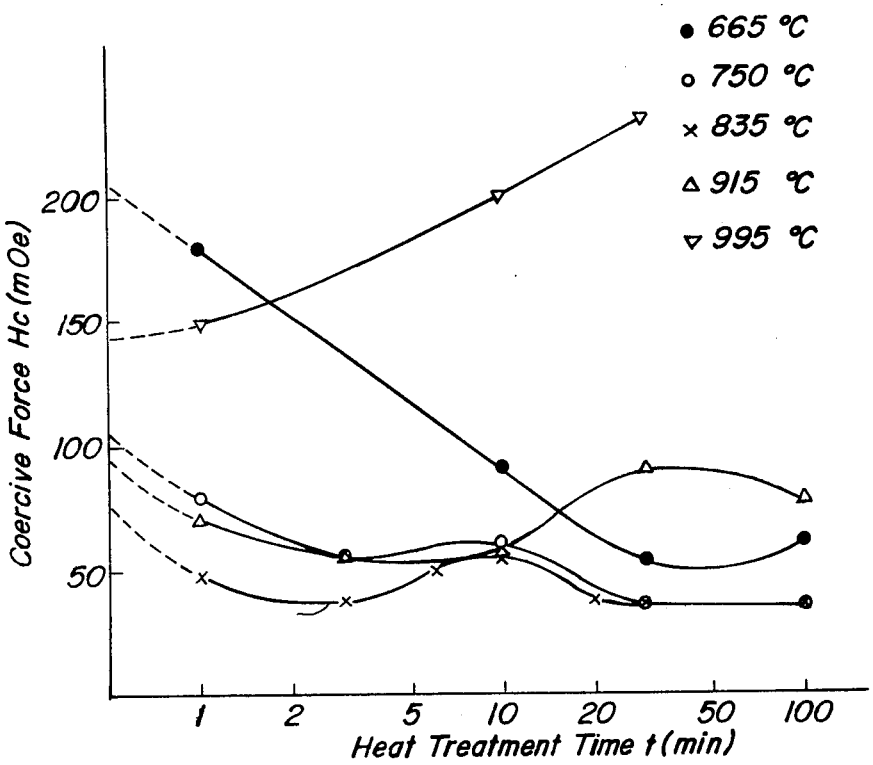
FIG. 7 shows a relation between a heat treating time and a coercive force of the thin ribbon according to the present invention.

FIG. 7 illustrates the relation between heating time and coercive force Hc. In this case, heat treating temperatures were selected from 665° C., 750° C., 835° C., 915° C., and 995° C., respectively. The coercive force Hc of non heat-treated thin ribbon was about 10 Oe, while coercive force decreases to the minimum value, except in the temperature of heat-treatment of 995° C., and gradually increases the maximum value after the lapse of time of the heat-treatment, respectively. However, it is observed that the coercive force Hc becomes minimum value of less than 0.03 in case of heat-treatment of 835° C. As can be seen from the above, the reason why the coercive force Hc of a thin ribbon according to the present invention becomes the minimum value is due to the change of magnetostriction and the grain gross and the tempering of strain.

Figure 8:
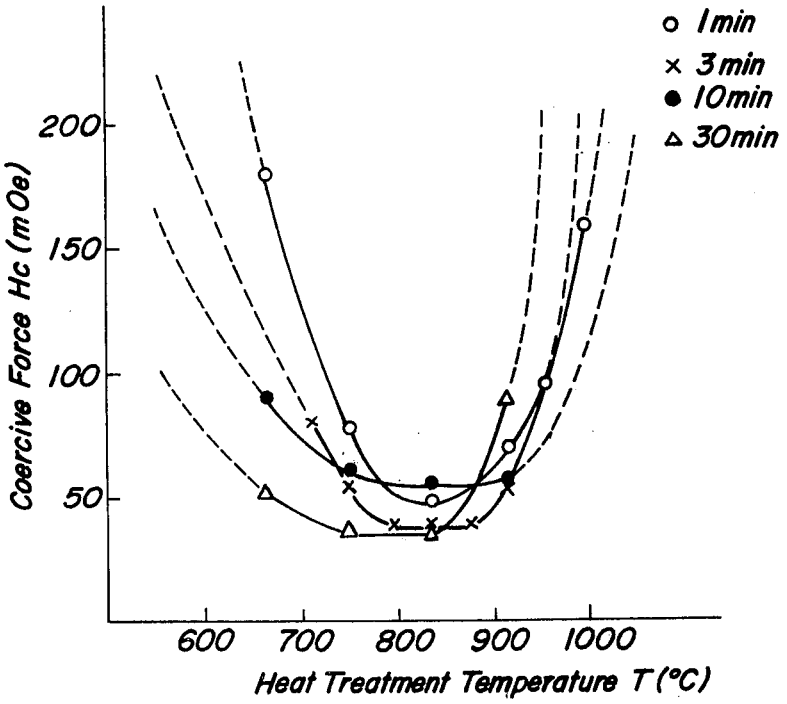
FIG. 8 shows a relation between a heat treating temperature and a coercive force Hc of the thin ribbon according to the present invention.

FIG. 8 illustrates the relation between a coercive force and a heat-treatment temperature in case of heating times of 1, 3, 10 and 30 minutes, respectively. It is observed that the coercive force takes minimum at about 835° C.

Figure 9:
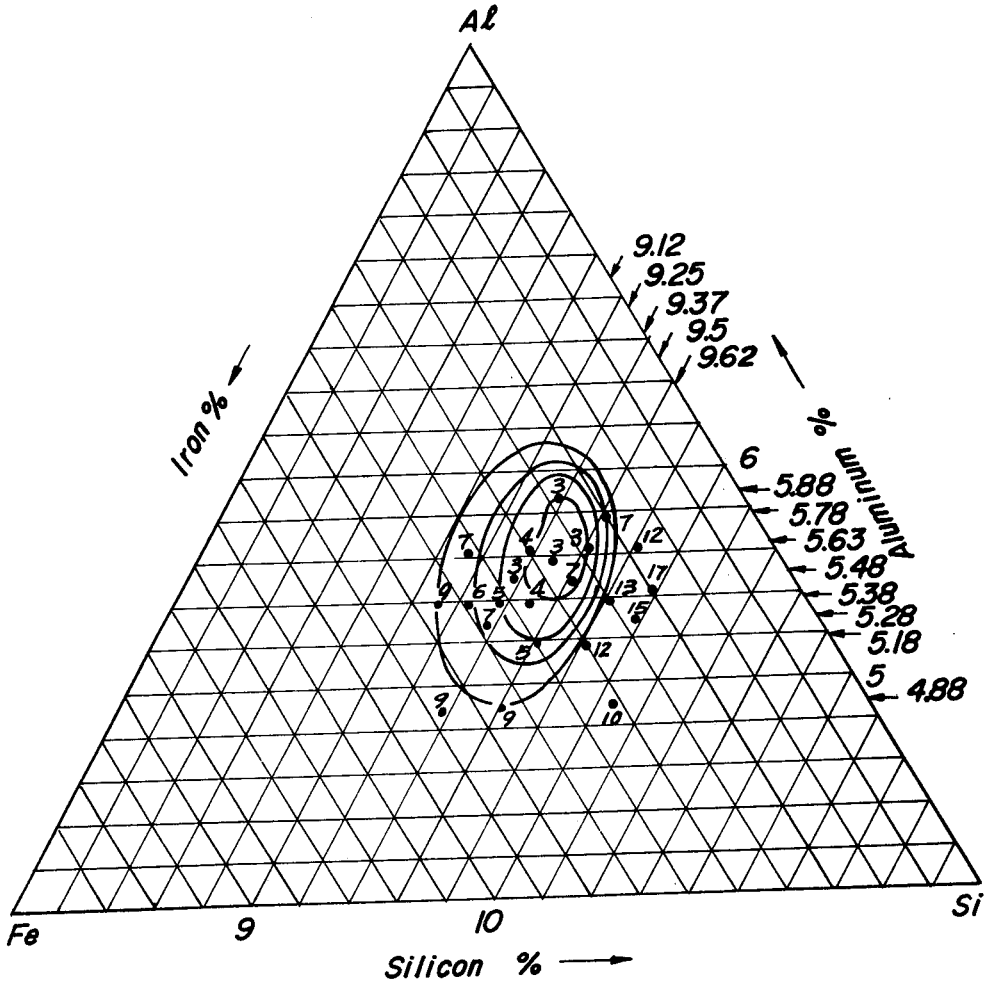
FIG. 9 shows a relation between a composition and a coercive force Hc of the thin ribbon according to the present invention.

FIG. 9 illustrates a relation between a coercive force and composition of a thin ribbon according to the present invention in case of a fixed heating time of 30 minutes and a fixed heating temperature of 835° C. respectively. In FIG. 9, contour lines designate values of coercive force respectively. The minimum value of coercive force (Hc) in a thin ribbon having a composition of Fe 84.9%, Si 9.62% and Al 5.48% resulted from this experiment was 24 mOe and this value is much smaller than the minimum value of coercive force reported in Sendust alloy in prior art.

Figure 10:
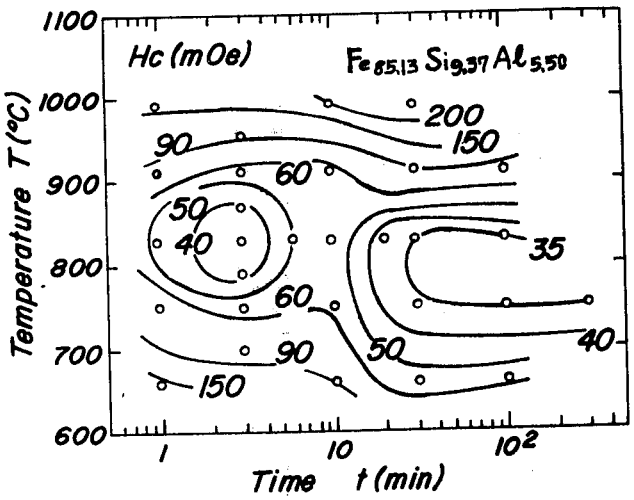
FIG. 10 shows a relation between a heat treating temperature and a heat treating time exerted on the coercive force Hc of the thin ribbon according to the present invention.

FIG. 10 illustrates the relation between coercive force Hc and heat treating time and heat treating temperature when a sample prepared from a thin ribbon having a composition of Fe 85.13%, Si 9.37% and Al 5.50% of about 50 μm in thickness according to the present invention and cut into a length of 10 cm was heat treated in a vacuum in an infrared heating furnace. In FIG. 10, the minimum value of coercive force (Hc) of 35 mOe was obtained when the sample was kept at a temperature within the range of 750–835° C. for more than 30 minutes.

The magnetic flux density of a thin ribbon having the composition of Fe 84.9%, Si 19.62% and Al 5.48% was 6,000 gauss at a static magnetic field of 0.3 Oe, 7,500 gauss at 1 Oe and residual magnetization was about 4,000 gauss. Thus, the initial permeability μo of about 30,000 was obtained from a B-H curve at a static magnetic field.

The frequency dependence of initial permeability and coercive force was examined in connection with a thin ribbon having a thickness of about 50 μm and a length of 68.5 cm coiled in the toroidal form and heat treated at a temperature of 835° C. in vacuum for 1 hour.

Figure 11:
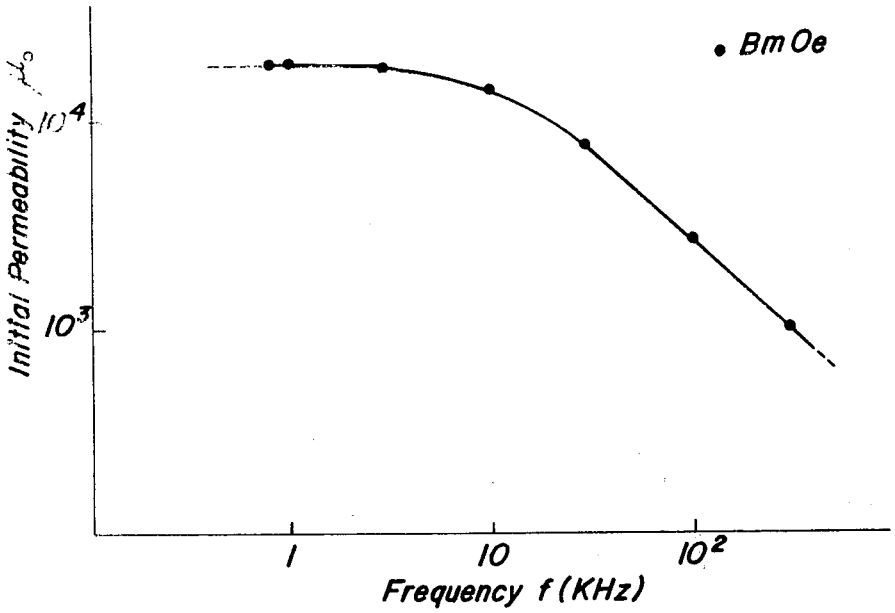
FIG. 11 shows a relation between an initial permeability $\mu o$ and a frequency of the thin ribbon according to the present invention.
Figure 12:
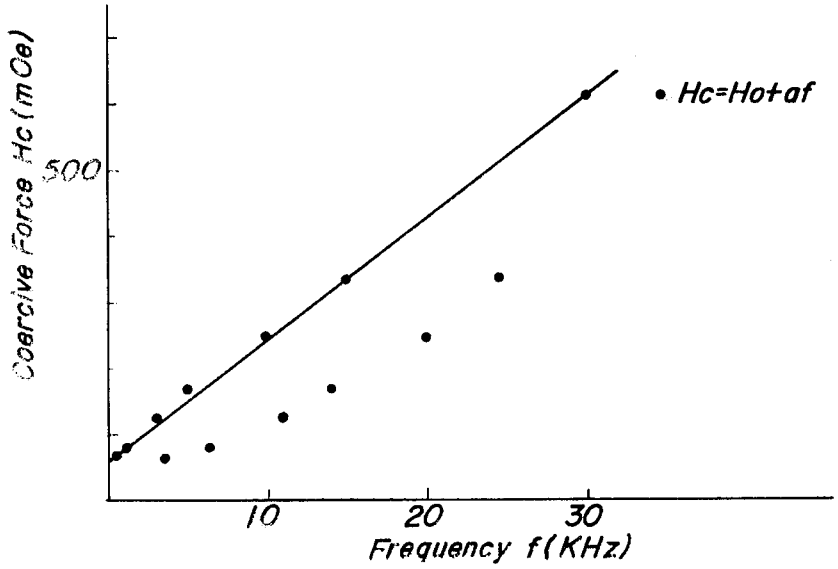
FIG. 12 shows a relation between a coercive force Hc and a frequency of the thin ribbon according to the present invention.

A change of initial permeability was observed as a function of an amplitude of a high frequency magnetic field at 800 Hz and the frequency dependence of initial permeability was smooth up to the amplitude of 5 mOe. FIG. 11 illustrates an experimental curve measured at room temperature under an alternative current magnetic field of 3 mOe in the region of from 800 Hz to 300 KHz, showing initial permeability being constant of about 19,000 without frequency dependency up to 10 KHz frequency, and thereafter it decreases to 10,000 in about 20 KHz. The frequency dependency of the initial permeability is almost explained by the theory of eddy current effect. FIG. 12 illustrates a characteristic feature of frequency dependency between coercive force Hc and frequency. It is observed that the coercive force measured by direct current was 40 mOe and it is increased as the frequency increases. The frequency dependency of loss factor tanδ was simultaneously measured and as a result loss factor tanδ increased linearly as the frequency increased. The loss factor tanδ is composed of a residual loss, a hysteresis loss and an eddy current loss, and a loss factor tanδ can be illustrated as a function of frequency f(Hz) and induction current i(A) as follows.

$$\tan \delta = C_1 + h_1 \sqrt{\frac{L}{V}}\, i + e_1 f \quad (1)$$

wherein $C_1$, $h_1$, $e_1$ are coefficients of residual loss, hysteresis loss and eddy current loss, respectively. L is an inductance of a core of a Henry unit, and V is a volume of a $cm^3$ unit. These coefficients are determined experimentally due to the frequency dependence and magnetic field dependency of loss factor tanδ when the initial permeability was measured. Table 1 shows the resulted data. Table 1 discloses a coefficient of loss and an initial permeability of Fe-Co series thin ribbon having 30 μm in thickness and the known 5 molybdenum permalloy having 25 μm in thickness in the prior art. It is obvious from this Table that the coefficient of loss $e_1$ is substantially the same between the thin ribbon according to the present invention and the known 5 molybdenum permalloy in the prior art. The loss factor of eddy current loss plays dominant role compared to other factors and it is very important in a thin ribbon according to the present invention, a thin ribbon of the known 5 molybdenum permalloy and Fe-Co series amorphous thin ribbon, and other loss of thin ribbon except eddy current loss is so small as negligible, in high frequency region. Eddy current loss of thin ribbon according to the present invention is an intermediate value of eddy current loss compared with that between 5 molybdenum permalloy and Fe-Co series amorphous thin ribbon. This means that electrical resistance ratio of thin ribbon according to the present invention is an intermediate value of molybdenum permalloy and Fe-Co series amorphous thin ribbon.

TABLE 1

| Composition | Thin ribbon according to the present invention 835° C. × 10 min. anneal* | 5-Mo permalloy | $Fe_5C_{70}Si_{15}B_{10}$ |
|---|---|---|---|
| Thickness | 32 | 25 | 25 |
| $\mu_i$ (10 KHz) | 14,000 | 22,000 | 5,200 |
| tan $\delta/\mu_i \times 10^6$ (10 KHz) | 24.3 | 25 | 6.9 |
| $C_1 \times 10^3$ | 16 | 94 | 7 |
| $h_1$ (cm/A) | 1,400 | 1,050 | 180 |
| $e_1 \times 10^6$ (sec) | 42 | 40 | 3.1 |
| ρ (μΩcm) | 88 | 55 | ~120 |
| Density | 6.4 | — | — |

Note:
*Thin ribbon according to the present invention consisting of $Fe_{85.13}Si_{9.37}Al_{5.50}$ annealed at 835° C. for 10 minutes.

Magnetostriction of the thin ribbon according to the present invention having five different kinds of composition was measured.

(1) Fe 85.35 Si 9.37 Al 5.28
(2) Fe 85.12 Si 9.50 Al 5.38
(3) Fe 84.9 Si 9.62 Al 5.48
(4) Fe 84.55 Si 9.82 Al 5.63
(5) Fe 84.75 Si 9.71 Al 5.55

Figure 13:
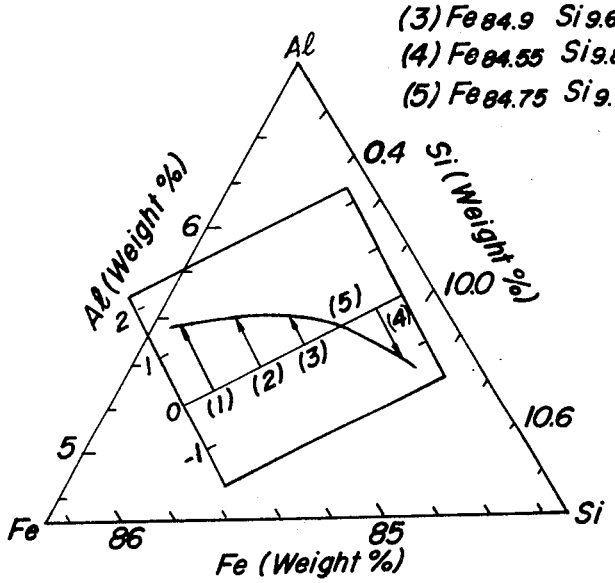
FIG. 13 shows a relation between a composition and a residual magnetic strain of the thin ribbon according to the present invention.
Figure 14A:
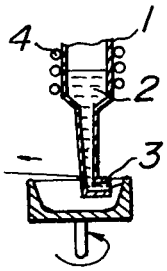
FIGS. 14(*a*), 14(*b*), 14(*c*), 14(*d*) and 14(*e*) show apparatuses for manufacturing the thin ribbon according to the present invention, respectively.
Figure 14B:
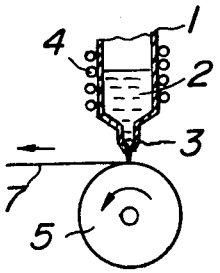
Figure 14C:
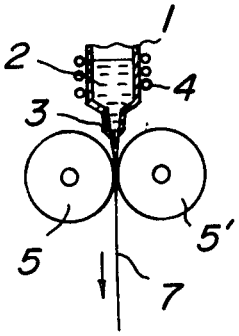
Figure 14D:
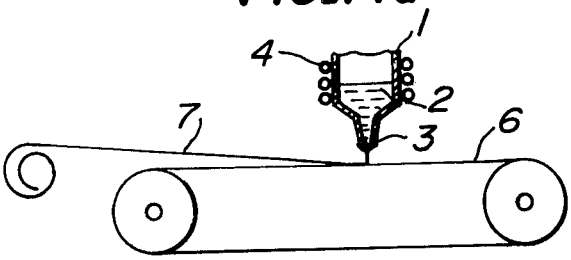
Figure 14E:
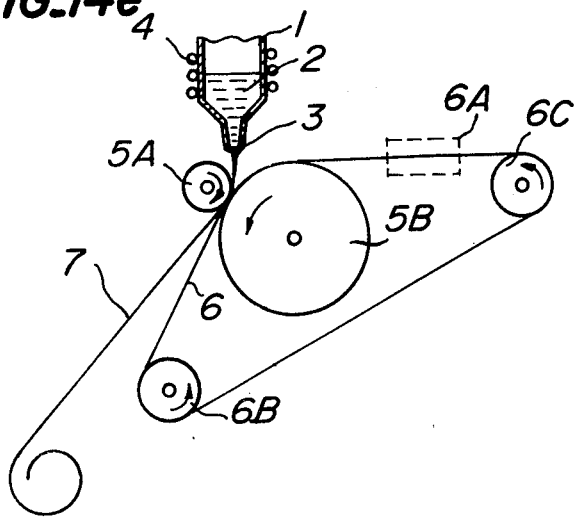

FIG. 13 illustrates the data plotted on three-dimensional diagram. It is observed that No. 5 composition of the thin ribbon is substantially zero.

Electric specific resistance of the thin ribbon according to the present invention is 100 μΩcm in non-heat-treated thin ribbon and 88 μΩcm in heat-treated thin ribbon at 835° C. for 30 minutes.

Difference between the former and the latter of electric specific resistance is due to the grain growth by heat-treatment. The grain growth of thin ribbon was obviously promoted the decrease of electric specific resistance by heat-treatment. Vickers hardness of thin ribbon according to the present invention was measured under the stress of 25-300 g. The Vickers hardness was 563 under the stress of 200 g and this value is greater than 500 of Vickers hardness reported in the bulk of Sendust alloy in the prior art.

An ejecting means of the melt onto said moving cooling substrate can be illustrated several devices shown in FIGS. 14(*a*), 14(*b*), 14(*c*), 14(*d*) and 114(*e*). In FIG. 14, reference numeral 1 designates a heat resistant tube, 2 a melt of magnetic material, 3 a nozzle, 4 a heater, 5 a moving or rotating substrate, 7 a thin ribbon of high permeability magnetic material, respectively. With the use of the device shown in FIG. 14(*a*), if the melt is ejected on the inner side rotating surface of the disc type rotating cooling substrate 5 from the nozzle 3, the melt is super-rapidly cooled and solidified, and a thin ribbon 7 can be formed continuously. When the melt is ejected on the outer peripheral surface of the drum type rotating cooling substrate 5 through the nozzle 3 by means of the device shown in FIG. 14(*b*), a continuous thin ribbon 7 can be manufactured. When the melt is ejected on the contact point of the rotating drum 5, 5' or its vicinity through the nozzle 3 by means of the device shown in FIG. 14(*c*), a continuous thin ribbon 7 can be manufactured. The thin ribbon produced by said method has a flat surface on both sides of the ribbon by super-rapid cooling under a pressure on both side surfaces of the thin ribbon between rolling surfaces of high speed roll. In this manner, the thin ribbon having high specific gravity can be obtained.

FIG. 14(*d*) illustrates the production of a continuous long thin ribbon 7 having flat upper and lower surfaces by super-rapid cooling and solidifying the melt ejected through a nozzle 3 on the moving surface of an endless belt type metallic conveyor body 6 and the melt is super rapidly cooled on conveyor body to form a thin ribbon. The linear speed of moving surface of endless belt type metallic conveyor body 6 may be 10–50 m/sec, preferably about 30 m/sec. FIG. 14(*e*) illustrates an apparatus according to the present invention. In FIG. 14(*e*), the melt is ejected through a nozzle hole 3 toward the contact point between a roll 5A and the metallic endless belt 6 backed up with a roll 5B, and the melt is super-rapidly cooled on the moving cooling substrate, i.e., the endless belt 6, and rolled between the roll 5A and the roll 5B through the conveyor 6, and the thin ribbon having an accurate size and figure and a flat and smooth surface on both sides of the thin ribbon can be obtained continuously. In FIG. 14(*f*) numeral 10 is a thermostat for metallic belt in which a temperature control can be applied thereto, if necessary.

It is preferable after treatment of thin ribbon to collect a thin ribbon ejected on a moving cooling substrate and super-rapidly cooled thereon and wound up to a reel having a small diameter by adsorbing with a magnet. The thus obtained thin ribbon can be pulverized into powder.

The thickness and width of the obtained thin ribbon according to the present invention can be determined by the property of the surface of the moving cooling substrate, the moving speed, the ejecting pressure, the ejecting temperature of the melt and the viscosity of the melt.

It is very important to select the material of cooling substrate depending upon the thin ribbon to be manufactured by taking into account the wettability between the melt of thin ribbon and the cooling substrate. The wettability is mainly determined by surface tensions of the melt and the substrate. When the temperature of the melt is too high more than 400° C. above the melting point, the melt might spread over the cooling surface of the substrate so that the ribbon becomes too thin and sometimes a greatly notched ribbon similar to a rattan blind might be produced, while when the temperature of the melt is too low, the jet flow of the melt might not creep along the surface of the substrate, so that the jet flow is divided into a number of small particles having irregular configuration. According to the invention, it is preferable to select such a surface tension of the melt that edges of the melt are made in contact with the substrate at an angle from 10° to 170°, preferably 45° to 135°, with respect to the substrate surface. For this purpose, the temperature of the melt should be selected within the range from the melting point to 300° C. above the melting point, particularly 100° C. to 150° C. above the melting point.

It is also very important that the melt of the thin ribbon should be instantaneously super-rapidly cooled on the cooling substrate at a suitable cooling rate of at least more than 1,000° C., preferably 1,000° to 1,000,000° C./sec by taking account of wettability between the melt of thin ribbon and the cooling substrate.

According to the invention, it has been found that the pressure under which the melt is ejected through the nozzle should be within the range of 0.01–1.5 atm.

The pressure for ejecting the melt is mainly determined by taking account of the viscosity of the melt, i.e., the temperature of the melt. If the pressure for ejecting the melt is lower than 0.01 atm., the melt cannot be ejected without exuding in the low viscosity and if the pressure for ejecting the melt is higher than 1.5 atm., the melt cannot be ejected without making a mist of the melt.

The ejection of the melt is preferably effected in a vacuum but it may be carried out in an inert gas or reducing gas atmosphere. Even in the latter case, it is preferable to reduce the pressure.

The reason why the atmosphere is preferably in vacuum or in a reduced pressure is as follows. If the melt is ejected in a normal atmosphere, the melt flow receives a force from the moving air with moving substrate, the resulting thin ribbon tends to turn into a greatly notched shape similar to a rattan blind or in partially shredding, contorting or corrugation shape. Therefore it is preferable to reduce the pressure of the atmosphere, when the condition of the publication should be varied in wide ranges. The reduction of the air pressure has an advantage to present the oxidation of the ribbon resulting in a ribbon with excellent magnetic properties. If the ribbon is manufactured by special conditions for certain special purpose in normal air atmosphere, the manufactured ribbon is deeply oxidized, resulting in poor magnetic properties and the ribbon usually becomes brittle.

According to the invention, it is possible to manufacture the thin and flexible magnetic thin ribbon of a fine microscopic structure of high density having a large mechanical strength and a high permeability and an excellent magnetic properties.

The material for the surface of the moving cooling substrate to receive the ejecting melt according to the present invention is selected from at least one element of the group consisting of copper, copper alloy such as beryllium-copper alloy, aluminum, aluminum alloy, titanium alloy, steel, alloy steel such as stainless steel, fused silica, and alumina. The melt of a thin ribbon having the composition according to the present invention has a good wettability to the moving cooling substrate made of aluminum, aluminum alloy, steel or alloy steel. Under the above reason, the moving cooling substrate made of aforesaid material such as steel, alloy steel, aluminum or aluminum alloy is superior for cooling property than that of the cooling substrate made of copper or copper alloy.

In the preferred embodiment for producing a thin ribbon according to the present invention, use is made of a rotating roll of 30 cm diameter and rotating speed of 2,000 rpm as a moving cooling substrate and the melt of 1,580° C. under an ejecting pressure of 0.5 kg/cm$^2$.

Figure 15:
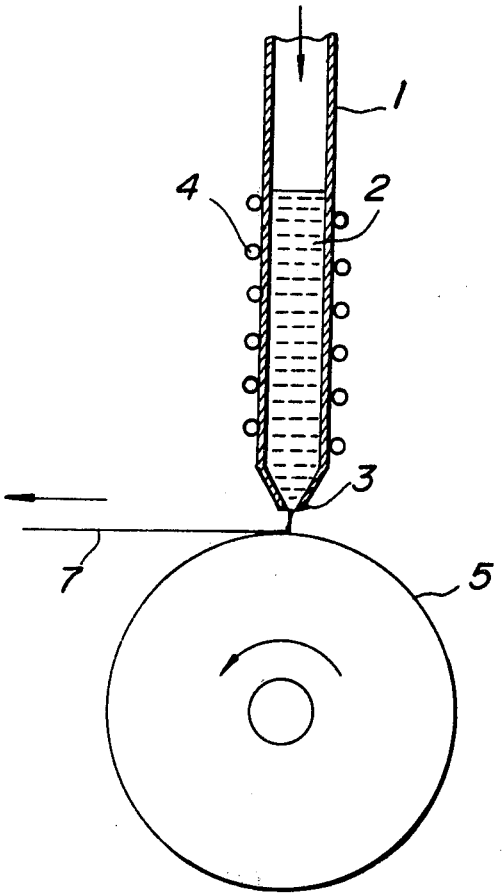
FIG. 15 is a fundamental diagrammatical view of an apparatus for manufacturing a thin ribbon of magnetic material according to the invention.

In FIG. 15, a melt of magnetic material 2 essentially consisting of by weight 4–7% of aluminum, 8–11% of silicon and the remainder substantially iron and inevitable impurities is introduced in a heat resisting tube 1. The heat resisting tube 1 is composed of a fused silica tube lined with boron nitride. The heat resisting tube 1 is provided with a nozzle 3 having a diameter of 0.1–0.5 mm at its free end. The melt of magnetic material 2 in the heat resisting tube 1 is maintained at a temperature of 1,250° –1,550° C. by means of a heating resistor 4. A cooling substrate 5 made of stainless steel is rotatably arranged below the heat resisting tube 1. The cooling substrate 6 is 300 mm in diameter and rotated at a speed of 2,000 rpm. The cooling substrate 5 is formed by a drum having a smooth and flat peripheral surface. The nozzle 3 is arranged close to the smooth and flat rotating surface of the drum 6. The melt of said magnetic material in the heat resisting tube 1 is ejected on the rotating surface through the nozzle 3 by adjusting the ejecting pressure within a range of 0.03–1.5 atmospheric pressure. As soon as the melt of said magnetic material is in contact with the rotating surface of the drum 5, the melt is quickly cooled on the rotating surface and a thin long continuous ribbon of magnetic material having a fine and compact microscopic structure and a high permeability is obtained.

The thus obtained thin ribbon of magnetic material is 5–30 μm in thickness and 0.1–0.8 mm in width. It was ascertained by X-ray diffraction patterns that this thin ribbon was substantially composed of a uniformly compact fine crystalline structure.

Figure 16:
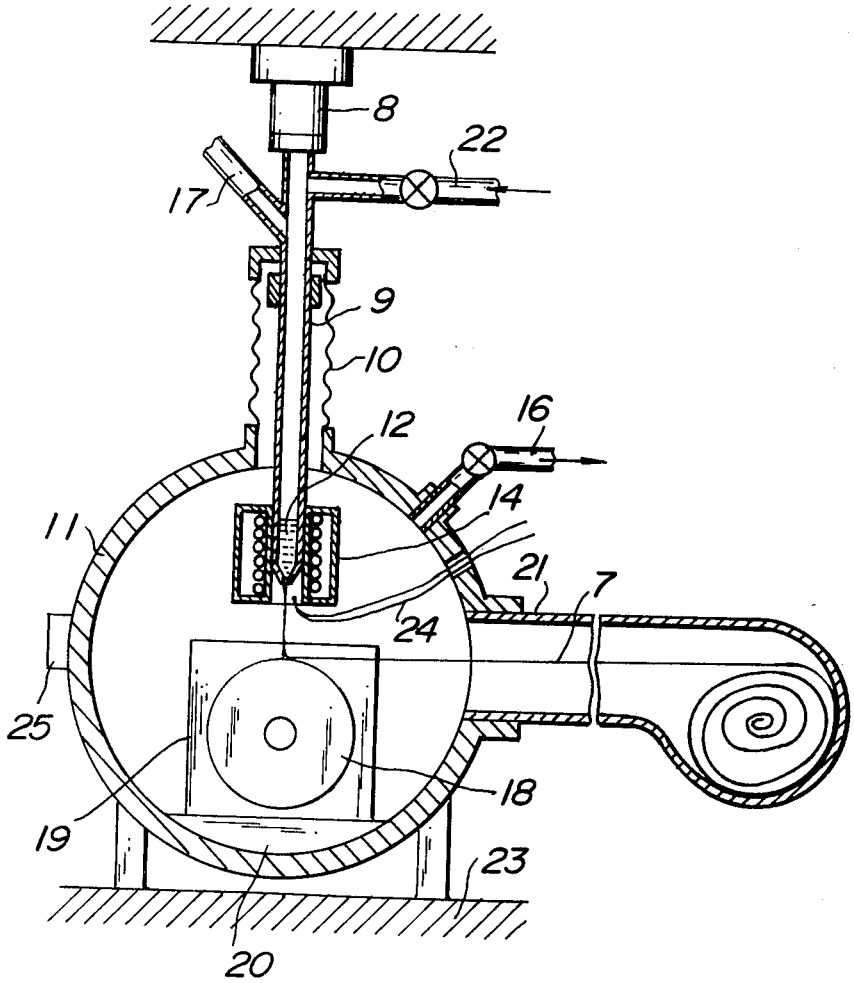
FIG. 16 is a sectional diagrammatical view showing experimental apparatus comprising a vacuum chamber.

Further, the thin ribbon of magnetic material was manufactured in vacuum with the use of a device shown in FIG. 16. In FIG. 16, a raw magnetic material 12 is inserted into a heat resisting fused silica tube 9 and heated to be molten at a temperature of 1,450° C. in an electric furnace 14. A temperature can be measured by a thermocouple 24. In this case, the vacuum chamber 11 placed on a base is evacuated from an outlet 16 by a vacuum pump (not shown) and maintained at high vacuum of $10^{-4}$ Toor. The chamber is provided thereon with a terminal plate 25 and is further provided theren with a cooling device comprising a rotating cooling drum 18 made of stainless steel having a diameter of 40 mm and a thickness of 10 mm secured to a variable speed motor 19, arranged on a support 20, whose speed varies 0–30,000 rpm. The pressures in the vacuum chamber 11 can be reduced within the range of $10^{-4}$ –760 Toor, and the atmosphere can be replaced by nitrogen, argon gas and the like for further pressure reduction. Prior to ejecting the melt 12, a shutter 13 is opened by handling a knob 15. The shutter 13 is kept closed before ejecting for preventing the drum 18 from being heated. Then, an electromagnetic valve (not shown) is turned on to actuate a cylinder 8 so as to lower the tube 9 to a position immediately above the rotating drum 18 which is rotated at a speed of 0–30,000 rpm, and argon gas at 0.5 atmospheric pressure is forced into the tube through a gas inlet 22. The melt of magnetic material is super-rapidly cooled on a rotating substrate drum and is quickly manufactured in a form of thin ribbon and gathered together in a collecting port 21 for taking out after the completion of the ejection. In this experimental device, it is possible to charge a raw material into an inlet 17 after the tube 9 has been heated. This device has an advantage in that any damage such as deformation or oxidation in the thin ribbon due to collision with air in atmosphere resulting from the super-rapid formation of the thin ribbon by the evacuation of vacuum chamber is considerably mitigated by reducing an atmospheric pressure, so that this device is very effective for obtaining long thin ribbon of magnetic material. In order to prevent an excessive oxidation, it is preferable to use an inert gas as the atmosphere at the reduced atmospheric pressure.

The thus obtained thin ribbon of magnetic material by super-rapidly cooling was 2.0 mm in widht, 30 μm in thickness and more than 10 m in length. The thin ribbon was made into a thinner one of about 0.5 μm in thickness by etching, whose electron beam diffraction pattern was observed by a 1,000,000 V perspective electron microscope. As a result, it has been found that the thin ribbon of magnetic material was of a compact and fine homogeneous crystalline structure.

In another emobidment, Si 0.37%, Al 5.5%, Fe 85.13% in atomic ratio were heated together in an $Al_2O_3$ tube by means of a tungsten heater to form a melt and the melt was ejected onto a smooth and flat outer surface of a drum type rotating cooling substrate made of beryllium copper alloy having 50 mmϕ in diameter rotating at 2,000–20,000 rpm with the aid of argon gas at 0.03–1 atmospheric pressure through a nozzle having a diameter of 0.1–0.5 mmϕ to obtain a thin ribbon of magnetic material having said composition and having 10–40 μm in thickness and 0.2–1.0 mm in width. In this case, the whole device was put into the above vacuum chamber 11 which was maintained at 1 atmospheric pressure or $10^{-3}$ Toor. Further, the vacuum chamber was previously filled with argon gas and the pressure in the chamber was reduced. The non-oxidizing atmosphere is effective to prevent an oxidation of the surface of the thin ribbon. Further, the effect of pressure reduction is remarkable in this embodiment. The damage such as deformations or creases due to the collision of the thin ribbon with the gas is reduced in vacuum or the reduced pressure, and as a result, a long thin ribbon having a good quality can be obtained.

Besides the above properties, the characteristics of the thin ribbon of magnetic material obtained by the method according to the invention will be explained as follows.

As mechanical strength, if thin ribbon having same thickness and same size is bent, its bending strength up to a fracture limit shows a high value of 2–3 times of those of common Sendust ingot. In other words, the mechanical strength of the thin ribbon according to the invention is considerably higher.

As described above, according to the invention, a thin magnetic ribbon is obtained with the compact fine structure by ejecting a melt of magnetic material through a nozzle and super-rapidly cooling it on the moving surface of a cooling substrate at a cooling rate of more than 3,000° C./sec up to 1,000,000° C./sec. The thus obtained thin ribbon can be manufactured at a remarkably high speed as compared with the conventional method for manufacturing a conventional thin ribbon and thus is very effective for the mass production of magnetic recording and reproducing head elements.

The present invention can be carried out not only by a nozzle having a single nozzle hole, but also by a nozzle having multi-nozzle holes.

The embodiment with respect to the multi-nozzle according to the invention will be explained in detail with reference to the following embodiments illustrated in FIGS. 17–21 .

Figure 17A:
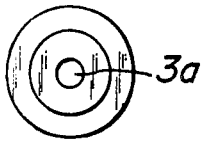
FIGS. 17(*a*) and 17(*b*) illustrate a heat resisting tube having a single circular ejecting nozzle hole for carrying out the method of the present invention.
Figure 17B:
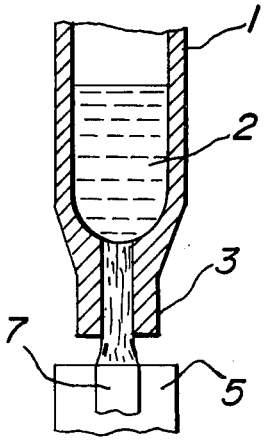

FIGS. 17(*a*) and 17(*b*) are bottom and cross-sectional views showing a regular nozzle. This nozzle has a circular ejecting nozzle hole 3*a* having a diameter of 0.1–1 mm and its characteristic is to be capable of obtaining a thin ribbon of magnetic material 7 having a width not smaller than the diameter even by ejecting a melt of magnetic material having high viscosity through the nozzle hole.

Figure 18A:
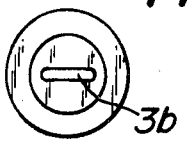
FIGS. 18(*a*) and 18(*b*) illustrate a nozzle having a laterally extended elliptical ejecting nozzle hole for carrying out the present invention.
Figure 18B:
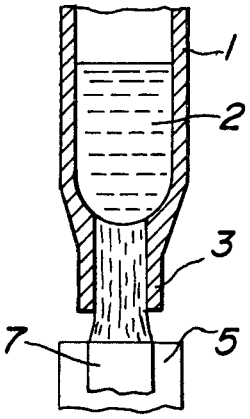

FIGS. 18(*a*) and 18(*b*) show a nozzle having an elliptical hole 3*b*. A characteristic of this nozzle is that the nozzle is suitable for manufacturing a thin ribbon of magnetic material 7 having a comparatively large width and capable of manufacturing a thin ribbon of magnetic material having a fairly large width.

Figure 19A:
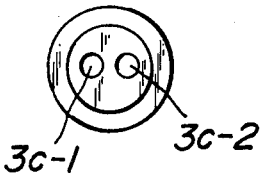
FIGS. 19(*a*) and 19(*b*) show a nozzle having two round holes arranged in a lateral direction for carrying out the present invention.
Figure 20A:
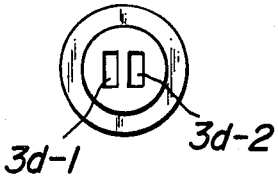
FIGS. 20(*a*) and 20(*b*) illustrate a nozzle having two rectangular ejecting nozzle holes arranged in a lateral direction for carrying out the present invention.
Figure 19B:
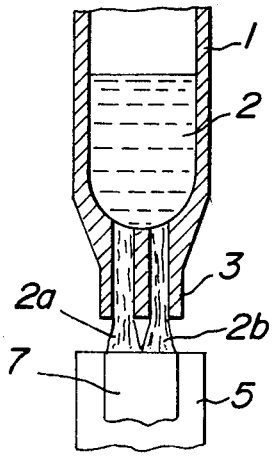
Figure 20B:
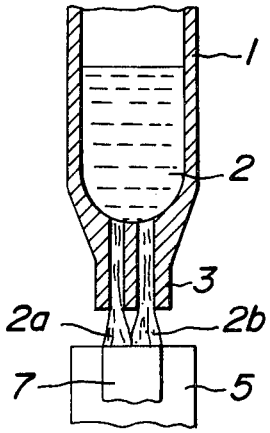

FIGS. 19(*a*) and 19(*b*); FIGS. 20(*a*) and 20(*b*) show another embodiments of a nozzle 3 having two circular and rectangular ejecting nozzle holes aligned adjacent to each other in a lateral direction respectively. FIGS. 19(*a*) and 19(*b*) show a nozzle 3 having two circular ejecting nozzle holes 3*c*–1, 3*c*–2 viewing from the end of nozzle, and FIGS. 20(*a*) and 20(*b*) show the nozzle 3 having two longitudinally extended rectangular holes 3*d*-1, 3*d*-2 arranged in parallel. A rotary axis of a rotating cooling substrate 5 is aligned in parallel to the direction for connecting the centers of these ejecting nozzle holes 3*c*-1, and 3*c*-2, 3*d*-1 and 3*d*-2, respectively. The principle for using this nozzle 3 is as follows. As described above, the width of a thin ribbon of magnetic material is generally wider than that of the nozzle hole. That is, a closely ejected melt 2 is widened in diameter when impinged upon a rotating cooling substrate 5 from the ejecting nozzle hole of the nozzle 3. As shown in FIG. 19, if two ejecting nozzle holes 3*c*-1 and 3*c*-2 are closely aligned, two parallel jet flows 2*a* and 2*b* of melt are impinged upon the rotating cooling substrate 5 and amalgamated with each other thereon. As shown in FIG. 20, if the longitudinally extended rectangular ejecting nozzle holes 3*d*-1 and 3*d*-2 are closely aligned, the two parallel jet flows 2*a* and 2*b* of melt get close to the circular cross section by surface tension during flowing down and amalgamated around at the surface of rotating cooling substrate 5. In this manner, a thin ribbon of magnetic material having a substantially twice larger width than that of the nozzle hole can be obtained. The melt of magnetic material thus becomes a thin ribbon of magnetic material having a large width. A size of the ejecting nozzle holes employed in this case is 0.6 mmϕ in diameter and 70 μm in nozzle hole space in case shown in FIG. 19 and 1 mm in length, 0.5 mm in width and 60 μm in nozzle hole space in case shown in FIG. 20. In both cases, use is made of a fused silicate tube as nozzle material and the ejecting nozzle holes are manufactured by means of an ultrasonic processor. The above magnetic material is molten at a temperature of 1,350° C. and cooled in super-high speed by means of a rotating stainless steel or copper drum type cooling substrate 5 under a pressure of 1 atom., a radius of 300 mmϕ, a thickness of 10 mm and a number of rotation of 2,000 rpm.

Figure 21A:
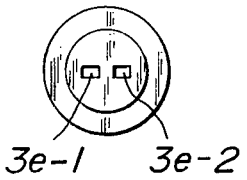
FIGS. 21(*a*) and 21(*b*) illustrate a nozzle having two laterally extended rectangular ejecting nozzle holes arranged in one direction.
Figure 21B:
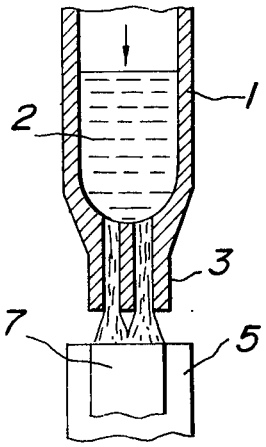
Figure 22A:
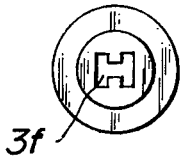
FIGS. 22(*a*) and 22(*b*) illustrate a nozzle having an H-shape ejecting nozzle hole in a cross section for carrying out the present invention.
Figure 22B:
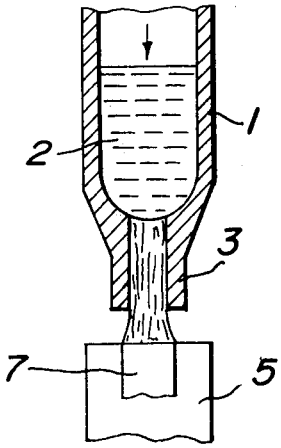

A nozzle 3 having elongated two nozzle holes **3*e*-1 and 3*e*-2 sufficiently closed with each other as shown in FIGS. 21**(*a*) and 21(*b*) is suitable for manufacturing a comparatively thin ribbon. This nozzle 3 can be applied to the manufacture of a thin ribbon of magnetic material having a large width under the condition similar to that for manufacturing the thin ribbon with using the conventional single hole nozzle. In particular, a thin ribbon of magnetic material having a width of 7 mm was obtained by ejecting the melt heated at a temperature of 1,350° C. under 0.6 atmospheric pressure through the nozzle 3 made of fused quartz provided with two rectangular holes **3*e*-1 and 3*e*-2 of 0.6 mm in length and 3 mm in width spaced apart from each other by 50 μm and by rapidly cooling the melt by bringing it in contact with the rotating cooling drum type substrate 5. In case that the viscosity of the molten jet is low, if use is made of the nozzle 3 having the ejection nozzle hole 3*f*, in which a center portion of the partition for spacing two elongated square type ejection nozzle holes 3*e*-1 and 3*e*-2 is removed by 50–100 μm as shown in FIGS. 22**(*a*) and 22(*b*), a more preferable result can be obtained.

Figure 23A:
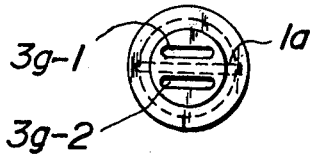
FIGS. 23(*a*) and 23(*b*) illustrate a nozzle having two laterally extended elliptical ejecting nozzle holes arranged in parallel direction for carrying out the present invention.
Figure 23B:
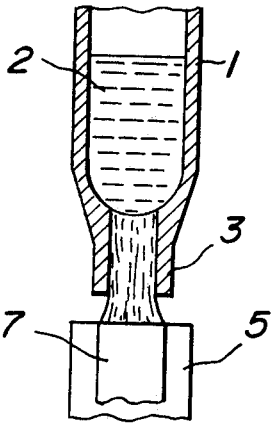

FIGS. 23(*a*) and 23(*b*) show another embodiment of the nozzle in which two elongated elliptical type ejection holes **3*g*-1 and 3*g*-2 are arranged side by side viewed in the direction of the rotation of the cooling substrate 5. Each of these nozzle holes is located in a chamber formed by a partition for containing two kinds of magnetic materials. When melts are ejected through these nozzle holes 3*g*-1 and 3*g*-2, it is possible to produce a double-layered thin ribbon. In the embodiment of this nozzle, provision is made of two ejection nozzle holes having 0.2 mm in length and 0.7 mm in width vertically spaced apart from each other by 50 μm. With the use of this nozzle, aluminum, silicon and iron are separately charged into the nozzle chamber and separately molten in the above two nozzle chambers at a temperature of 1,500° C., these two chambers are connected to a common pressure source for ejecting at a common atmospheric pressure of 0.7 and super-rapidly cooled by ejecting onto said rotating cooling substrate 5** at a cooling rate of 1,000° –1,000,000° C. /sec. The thus obtained thin ribbon is of a double-layered structure having about 0.8 mm in width and about 50 μm in thickness. In this manner it is possible to form a magnetic thin ribbon.

Figure 24A:
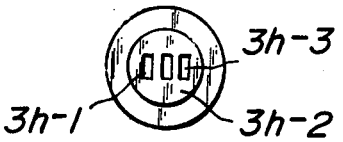
FIGS. 24(*a*) and 24(*b*) illustrate a nozzle having a plurality of three longitudinally extended elliptical ejecting holes arranged in parallel direction for carrying out the present invention.
Figure 24A:
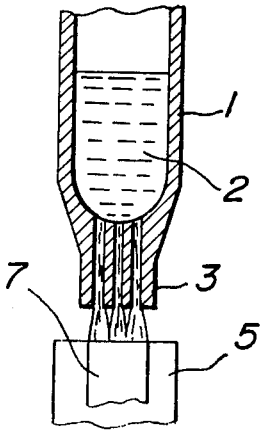

FIGS. 24(*a*) and 24(*b*) illustrate another embodiment of the nozzle having three elliptical ejection nozzle holes **3*h*-1, 3*h*-2, 3*h*-3**. In this case, as far as three nozzle holes are not spaced apart from each other, a thin ribbon three times wider than the width of ejection nozzle holes can be obtained. That is, for example, three elliptical ejection nozzle holes having 1 mm in length and 0.7 mm in width are spaced apart from each other by 100 μm, a thin ribbon having a width of 2.3 mm was produced. This embodiment is suitable for manufacturing a compartively thick ribbon. The multi-hole nozzles of the present embodiment and the preceding embodiments are not preferable, if a space between the ejection nozzle holes is too wide, because creases might be formed in the finally obtained thin ribbon. In case, except the positive use of this crease, it is preferable to make a thickness of the partition between the ejection nozzle holes at least less than ⅓ of the longest size of the ejection nozzle hole, and it is more preferable to make the thickness 1/5 to 1/10. By using such a nozzle, the thin ribbon of magnetic material having a desired width was obtained. However, if a thickness of the partition is too thin, such as less then 40 μm, the partition is easily broken.

Figure 25A:
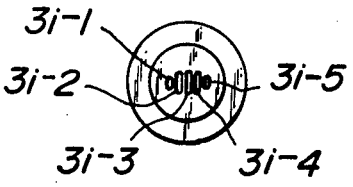
FIGS. 25(*a*) and 25(*b*) illustrate a nozzle having a plurality of longitudinally extended rectangular ejecting holes arranged in lateral direction and having a pair of sub-ejecting holes arranged in both outermost portion for carrying out the present invention.
Figure 25B:
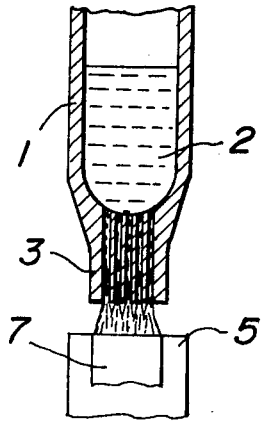
Figure 26:
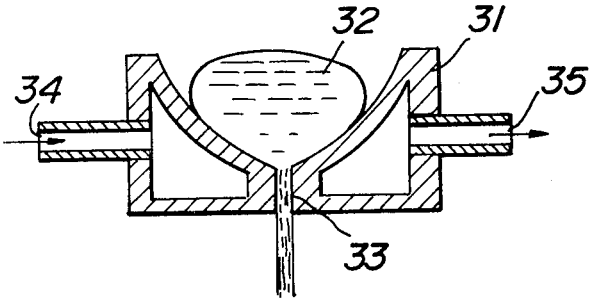
FIG. 26 shows a sectional view of a nozzle having cooling means according to the present invention.

FIGS. 25(*a*) and 25(*b*) show still another embodiment of the multi-hole type nozzle having five long elliptical ejection nozzle holes **3*i*-1 to 3*i*-5 laterally aligned in a row. With the aid of such a nozzle, a thin ribbon of magnetic material having a width about 5 times larger than the diameter of the ejection nozzle hole is formed. The principle of this nozzle is as follows. For comparison, in the nozzle shown in FIG. 18, a length of the laterally elongated elliptical ejection nozzle hole 3*b* is same as a total length of the ejection nozzle hole row of the nozzle shown in FIG. 25. When the jet of the melt is flowed down through the wide elliptical nozzle hole 3*b*, the width of the molten jet flow becomes gradually narrow as flowing down and at the same time a thickness of the molten jet flow measured in a direction perpendicular to the width becomes thick. If the width of the molten jet flow becomes large, the defect might often occur at the center position or any other position of the thin ribbon. It means that the molten jet flow is not uniformly flowed down over the width but both side portions of the jet flow are obliquely flowed down toward the center, so that the jet flow is concentrated into the center portion. In the embodiment shown in FIG. 25, however, the ejection nozzle holes 3*i*-1 to 3*i*-5 are laterally aligned in a row, each jet flow is flowed down in parallel to each other, and all the jet flows are amalgamated on the surface of rotating cooling substrate 5. This principle is same as the embodiments shown in FIGS. 19 and 20. The nozzle shown in FIG. 25 has the following specification as compared with the embodiment shown in FIG. 24. Three central holes 3*i*-2, 3*i*-3, 3*i*-4, form a main hole row and two slightly small sub-holes 3*i*-1 and 3*i*-5** on both sides of the main hole row have about 80% hole width as compared with three main holes for reducing an edge effect on both sides of the thin ribbon. In one embodiment of the invention, the width of the main hole is 0.8 mmϕ, the width of the sub-hole is 0.7 mm and the space of the ejection nozzle holes is 80 μm. The ejection holes of this embodiment can easily be formed with the aid of an ultrasonic machine. By rapidly cooling a melt of Fe-Si-Al alloy with the use of the present nozzle under the condition previously found by the inventor, thin ribbon of Fe-Si-Al alloy having about 5 mm to 10 mm in width were obtained.

As nozzle material, each kind of material can be selected in accordance with purposes. For example, fused quartz can be used over the range of 1,000° C. or more than that, i.e., several hundred degrees in centigrade. As nozzle material, use is made of heat resisting ceramics such as $Al_2O_3$, MgO, beryllium oxide, etc. The nozzle made of such ceramics is preferably lined with boron nitride at a lower portion, particularly on an inner surface. In this case, magnetic material can be molten at a high temperature. Particularly, a nozzle made of boron nitride has been found preferably for manufacturing the thin ribbon of magnetic material. Particularly, when a reduced atomosphere or vacuum is required, this nozzle material is effective and preferably available in a vacuum chamber. The lining of the lower portion, particularly the inner surface of the nozzle lined with niobium nitride, is very effective for weakening a reaction of the melt with nozzle material.

The present invention is explained in detail in FIGS. 26 to 29 with respect to several embodiments of a heating melting apparatus with a nozzle having a water cooled nozzle hole.

(a) Heating melting apparatus by arc

Figure 27:
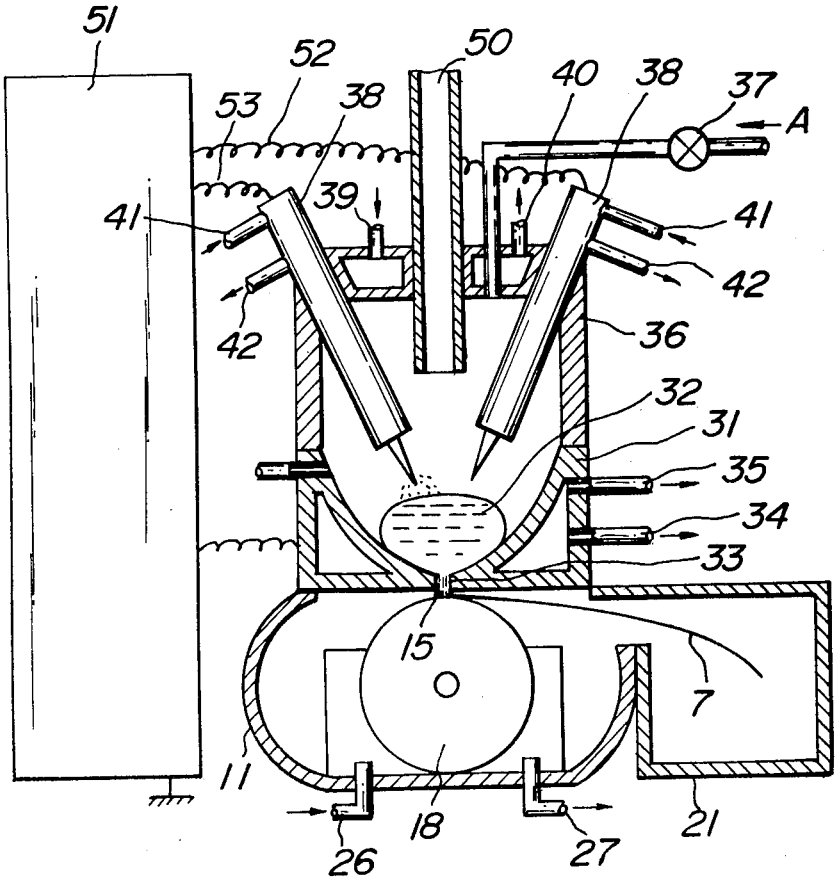
FIG. 27 shows a sectional view of manufacturing apparatus of thin ribbon according to the present invention by using arc heating device.

In case the thin ribbon material is conductive body, the ejecting portion of water cooled nozzle 31 having an inlet 34 and outlet 35 is covered by heat insulating tube 36, and the raw material is charged into the insulating tube 36 through charging inlet 50 of raw material provided in the upper portion of said heat insulating tube 36. An inert gas such as argon is introduced to the said heat insulating tube 36 so as to be inert gas atmosphere, the raw material is heated by arc with the use of an electrode 38 made of tungsten and a melt 32 is formed. In FIG. 27, reference numerals 39 ,40 are an inlet and an outlet of a cold medium for cooling the ceiling portion of the heat insulating tube 36, respectively, while reference numerals 41, 42 are an inlet and an outlet of a cold medium for cooling an electrode, respectively. Reference numeral 51 is an electric source, 52 and 53 are electric conductors connecting to respective electrodes 38, 38. In the melting means of the apparatus according to the present invention, it is preferable to use such kind of gas for forming an inert gas atmosphere that it does not contaminate the melt.

Reference numeral 18 is a rotating cooling substrate drum, 15 a melt jet, 11 a vacuum tank, 26 and 27 an inlet and an outlet of inert gas, and 7 is a thin ribbon to be formed.

Figure 28:
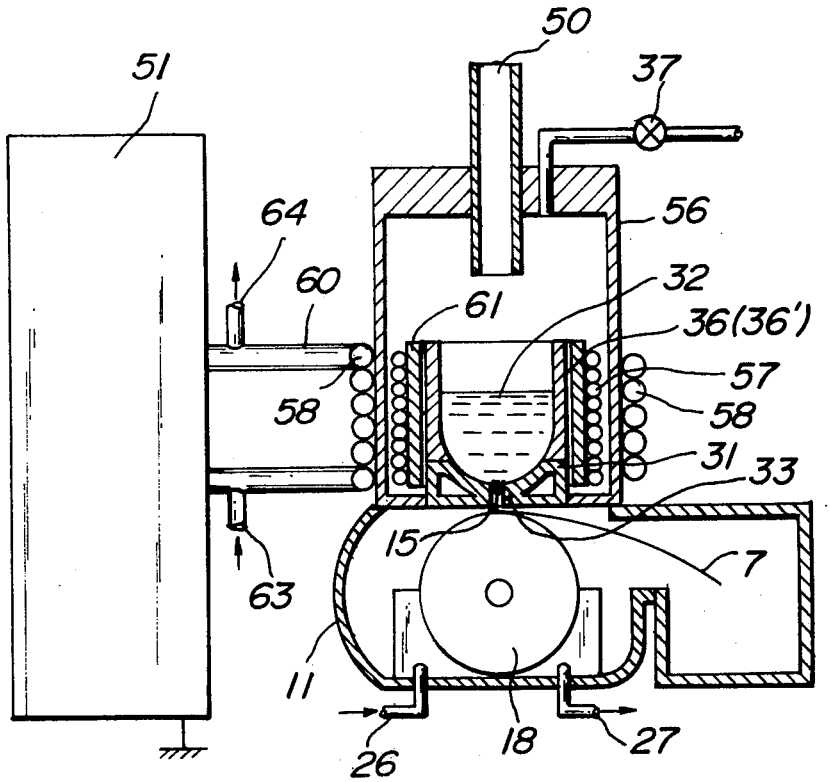
FIG. 28 shows a sectional view of manufacturing apparatus of thin ribbon according to the present invention by using a high frequency induction heating means.

FIG. 28 shows an embodiment of an arc melting apparatus with the use of one electrode 38 and the earthed ejecting portion 33 as an anode and cathode. The melting by arc may be carried out with the use of three electrodes of a 3-phase alternating current. It is also possible to produce a melt by using an electrode with special carbon, if necessary, and the electrothermic melting is carried out by directly flowing a current between said melt and said electrode. In another embodiment, said melt 15 is directly obtained by electric heating in a manner that the electrode 38 made of copper alloy or the like is fully cooled by cold medium and the reaction with said melt 32 and the electrode 38 is faintly kept.

(b) Heating melting means by high frequency induction

As shown in FIG. 28, it is possible that a heat insulating tube 36 made of boron nitride or the like is placed on the upper portion of an ejecting portion of nozzle 31 cooled by cold medium as a melting chamber, and a coil 57 made of a copper pipe or the like is provided by surrounding the outside of said melting chamber 36 and the outside of said melting chamber 36 is covered with a heat insulating tube 61, and to flow atmospheric gas into the melting chamber 36 made of insulating tube through a valve 37. The raw material is charged in the melting chamber 36 through an inlet 50. Thus, the raw material is heated and melted by transmitting a high frequency current to the coil 58 and a melt 32 can be obtained. In FIG. 28, reference numeral 51 is a high frequency electric source, 63 and 64 are an inlet and an outlet of a coolant for cooling wirings 58.

In the above high frequency induction heating device, if the raw material is an insulator, a platinum-rhodium tube 36' is connected to the upper portion of the cooled ejecting nozzle 31 instead of said insulating tube 36, and the raw material is charged therein, a high frequency current is transmitted into a high frequency coil 58 provided at the outside of said platinum-rhodium tube and said platinum-rhodium tube 36' is heated by high frequency induction, thereby a melt is obtained. In this case, if the melt is strongly intended to react with the platinum-rhodium tube 36', it is preferable to provide an inner tube made of boron nitride which scarcely reacts with said melt, and the charged raw material in the inner tube is heat by high frequency.

(c) Heating melting means by burner

Figure 29:
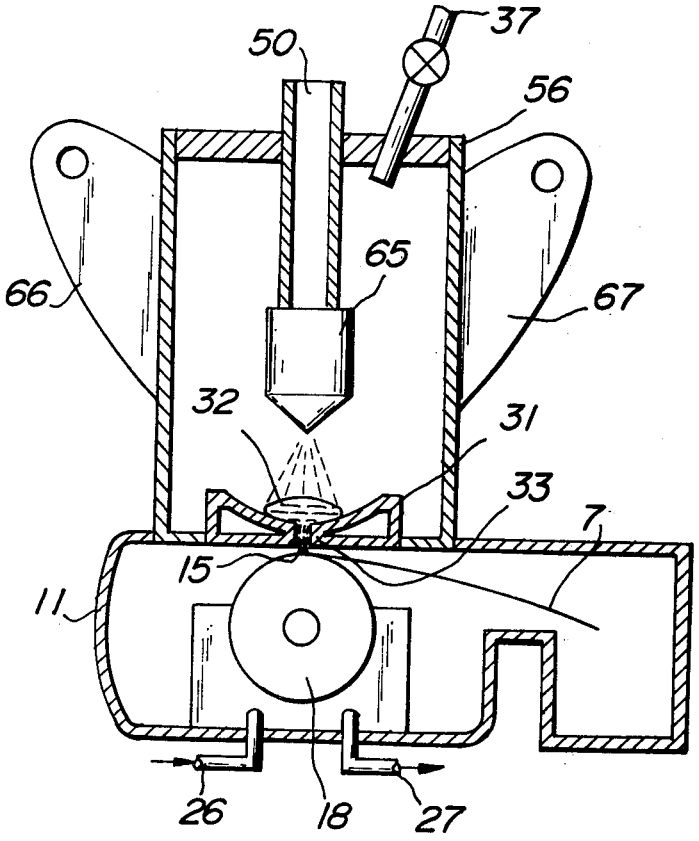
FIG. 29 shows a sectional view of manufacturing apparatus of thin ribbon according to the present invention by using a heating means of burner.

In FIG. 29, the material of melt 32 is heated and melted by a gas burner 65. A combustion gas source for said burner 65 may be used of the mixtures of oxygen and hydrogen, acetylene and oxygen, propane and oxygen, etc. A heating flame can be oxidizing, reducing or neutral by adjusting a supply amount of oxygen. It is obvious that said apparatus can be provided an effective means in case the characteristic of said thin ribbon is not deteriorated by the inclusion of carbon.

In FIG. 29, reference numeral 56 is a heat insulating tube, 37 a gas inlet valve for pressurizing and adjusting atmosphere, and 50 is an inlet of a raw material of melt.

Besides the above (a) heating by arc, (b) heating by high frequency induction and (c) heating by burner, a melt can be obtained by indirect heating of one or more than two selected from heating by infrared ray, heating by sun light, heating by laser and heating by plasma jet. It is also possible to make a melting atmosphere to a considerably high vacuum and to use electron beam heating. In the above heating means by infrared ray are used reflection mirrors 66, 67 shown in FIG. 29. In short, it is advantageous to employ any heating method suitable for the composition, weight, temperature and melting atmosphere of the melt.

The magnetic head made of a thin ribbon of magnetic material according to the present invention consists of by weight aluminum 4–7%, silicon 8–11% and the remainder substantially iron, and is composed of thin ribbon having a high permeability and flexibility at the contact portion with a magnetic tape which can be easily wound up around a rod having a diameter of at least less than 10 cm.

In the magnetic head according to the present invention, said thin ribbon is used in the form of a predetermined laminated and adhered head core and is used at least at a front gap at the contact portion with a magnetic tape.

The thin ribbon according to the present invention is used to the contact portion of head core with a magnetic tape instead of ferrite block in the form of predetermined configuration.

The thin ribbon according to the present invention is used at least at the contact portion of magnetic head with a magnetic tape. The method of manufacturing of said thin ribbon is simple and said thin ribbon is, easy in adhesion, high in productivity, excellent in magnetic property and wear resistance, particularly excellent in high frequency characteristic because it is thinner than the conventional Sendust thin sheet, and it has a long life.

The thin ribbon according to the present invention is suitable for not only magnetic head but also magnetic core of transformer, converter and the like.

In case of forming a magnetic head core composed of the thin ribbon according to the present invention, a part or the whole of laminated layers of thin ribbon is adhered to each other by using a technique of aluminum soldering, if necessary, and the work can efficiently be carried out by using an ultrasonic wave working, a high voltage discharge working or a synthetic working. Further, this adhered solder can be removed by heating, chemical treatment or the like, if necessary.

In case that the thin ribbon according to the present invention has some warps, such warps can be removed by heating the thin ribbon by passing through an electric heating zone. Further, such warps can be removed by applying a pressure with the use of a roll on both sides of the thin ribbon during heating.

The present invention will be explained with reference to embodiments.

EXAMPLE 1

With the use of an apparatus shown in FIG. 27, a high permeability alloy essentially consisting of by weight Fe 85.13%, Si 9.37% and Al 5.50% according to the present invention was manufactured. Raw material having said composition was charged into the melting chamber 36 connected to nozzle 31 made of boron nitride and heated and melted by means of a high frequency induction heating furnace to obtain a melt 32. The thus obtained melt was ejected as a jet flow onto a roll surface rotated at a high speed by pressuring with argon gas from valve 37. The melt was super-rapidly cooled at a rate of about $10^4$° C./sec, solidified, run as a thin ribbon and collected in a thin ribbon collecting portion 21. The roll used in the above embodiment is 4–150 cm in diameter. As material of the roll, use was made of copper, stainless steel, aluminum and the like. A rotating speed was 25,000–100 rpm. In this case, if the nozzle, the heating apparatus, the roll are placed in a vacuum chamber and the vacuum chamber was maintained in a high vacuum of $10^{-6}$ Torr, the oxidation of the surface of thin ribbon can be suppressed to a very small amount.

A thin ribbon was then manufactured under such conditions that the roll made of copper was 10 cm in diameter, a rotating speed was 1,500 rpm, the pressure was $10^{-5}$ Torr, the inert gas such as argon, nitrogen or the like and the air is used, and the thus manufactured thin ribbon was annealed at a temperature of 835° C. for 30 minutes. The mechanical and magnetic properties of thus manufactured thin ribbon was as shown in the above Table 1.

The thin ribbon thus manufactured according to the present invention has almost same magnetic properties as Sendust, but it can be easily wound up around a bar having a diameter of 10 cm. Further, such thin ribbon which iron can be substituted by 2% nickel has a sufficient flexibility so as to be substantially able to be easily wound up around a rod having a diameter of 2 mm.

The thin ribbon according to the present invention consists of a columnar crystal structure almost perpendicular to the ribbon surface, its crystal grain is a compact and fine polycrystallite less than about 30 μm, and when a heat treatment is applied if necessary, the magnetic property can be improved as the growth of crystal grains, and the thus obtained thin ribbon has a high permeability and a high strength against bending, and it is expected to be used as magnetic head, core and other wide range of usage.

EXAMPLE 2

Heat-treated Sendust thin ribbons were laminated and embedded with resin, worked with ultrasonic waves and shaped into a ring of 3 mm in outer diameter, 2.5 mm in inner diameter and 0.25 mm in thickness. The thus obtained magnetic core was cut into a pair of a semicircle, the cut end surfaces were finely ground, the ground surfaces were faced with each other and integrated in the form of a ring. In this case, a glass plate of 1 μm in thickness was inserted between the ground surfaces of magnetic core. The magnetic core was further coiled by winding up a wire of 300 turns, and thereafter, it is embedded in a mold of synthetic resin material and a ring type magnetic head 71 shown in FIG. 30 was formed. A space between the end surfaces sandwiched the glass sheet 73 and ground, was a magnetic gap and the magnetic gap forming surface was precisely ground. In addition, reference numeral 75 is a binding portion of the rear gap. This magnetic gap was observed by a microscope and as a result, it was found that a mechanical precision was fully maintained. Magnetic recording and reproducing characteristics of this magnetic head were also observed, and a sufficient electromagnetic conversion characteristic especially in high frequency region and an abrasion resistant characteristic were obtained enough as compared with a conventional Sendust magnetic head.

Figure 30:
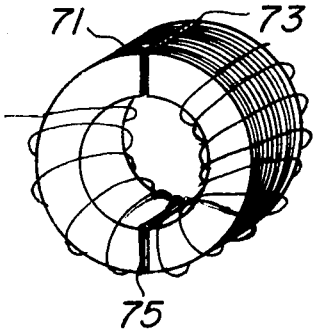
FIG. 30 is a perspective view of the ring-type magnetic head according to the present invention.
Figure 31:
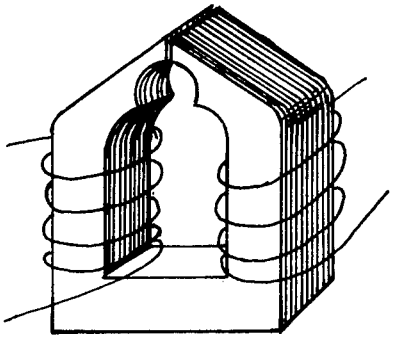
FIG. 31 is a perspective view of the overall magnetic head according to the present invention.
Figure 32A:
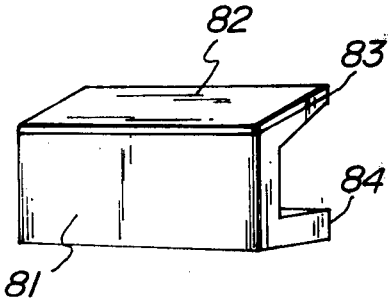
FIGS. 32(*a*), 32(*b*), 32(*c*) and 32(*d*) are perspective views of parts in the process of assembling another magnetic head according to the present invention, respectively.
Figure 32B:
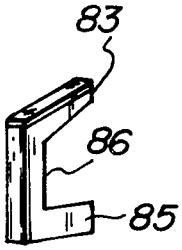
Figure 32C:
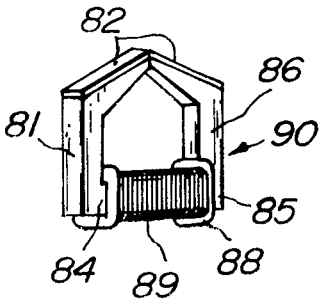
Figure 32D:
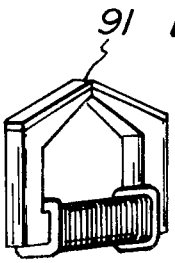

FIG. 31 shows an overall magnetic head having a shape different from the ring-type magnetic head shown in FIG. 30. This magnetic head is a thin ribbon manufactured in the same manner as shown in FIG. 30. The magnetic heads shown in FIGS. 30 and 31 are manufactured by laminating 10-odd sheets of a thin ribbon for audio and 2–3 sheets of a thin ribbon for video and disc. For video and disc, use is made of a coil of several to several ten times.

EXAMPLE 3

Another embodiment of the magnetic head according to the present invention will be explained in the order of working steps with reference to FIGS. 32(*a*), to 32(*b*).

The cross section shown in FIG. 32(*a*) is ground in the form of a predetermined configuration of head core and a ferrite block 81 is manufactured. To this ferrite block 81 is adhered a Sendust thin ribbon 82 as shown in FIG. 32(*a*). As the above adhesion, an epoxy bonding agent can preferably be used. A head gap portion 83 and a butt joint portion of head core 84 are ground and finished by ramping grinding. As shown in FIG. 32(*b*), the ferrite block 81 is adhered to the thin ribbon 82 and cut into a thickness of a predetermined head core in an adhered condition and a number of head cores 86 are manufactured. Said head core 86 is inserted into a coil 89 coiled around a bobbin 88 as shown in FIG. 32(*c*), butted each other and fixed by a bonding agent. In this case, the butt surface of the head gap portion 83 is provided with a spacer having a suitable thickness. The thickness of this spacer is different each other depending upon the use of the head such as a reproducing head, a recording head or an erasing head. A tape running surface 91 shown in FIG. 32(*d*) is ground into a curved surface and a head is completed. The tape running surface 91 is ground in general after a head unit 90 shown in FIG. 32('c) is put into a shield case and fixed in the shield case by filling a bonding agent, but the shield case is not illustrated in FIG. 32(*c*).

EXAMPLE 4

Figure 33A:
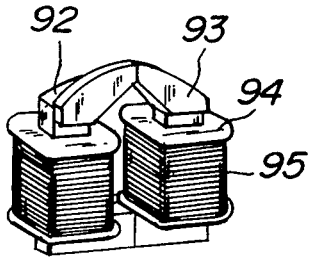
FIG. 33(*a*) is a perspective view of another magnetic head according to the present invention, and FIG. 33(*b*) is a vertical view of the same magnetic head.
Figure 33B:
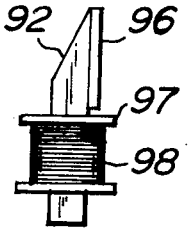

A further embodiment of the magnetic head according to the present invention is shown in FIGS. 33(*a*) and 33(*b*).

In FIGS. 33(*a*) and 33(*b*), reference numeral 92 is a ferrite core, 93 a chip made of a Sendust thin ribbon, 94 a coil bobbin and 95 a coil. That is, the magnetic head shown in FIGS. 33(*a*) and 33(*b*) is manufactured by laterally adhering a Sendust thin ribbon chip 96 to a ferrite core. The tape running surface of the ferrite core 92 is cut as shown in FIG. 33(*b*) for contacting the chip 96 only with the tape. The head having such construction is advantageous to reproduce a tape having a narrow truck width and preferable as a VTR head.

EXAMPLE 5

A raw magnetic material consisting of Fe 85.13%, Si 9.37% and Al 5.50% was introduced into a nozzle made of fused silica, heated and molten in a resistance furnace made of silicon carbide in the air, and the melt is ejected through the nozzle toward between steel rolls having a diameter of 6 cm rotating at 3,000 rpm as a jet flow of melt under the pressure of argon of 1.0 atm. Argon gas was blown toward the nozzle hole and between the rolls under a reduced pressure of 0.2 atm so as to avoid oxidation of the ejected melt having a high temperature. Said rolls were heated by an infrared ray heater and the temperature of said rolls was changed from a room temperature to 600° C. and the flexibility of the thus obtained magnetic thin ribbon having a width of 8 mm and a thickness of 100 μm was tested. FIG. 34 illustrates the results thereof, in which an abscissa is a roll temperature and an ordinate is a possible diameter to laminate 10 times without breaking the thus obtained thin ribbon.

As can be seen from the above results, a minimum laminatable diameter becomes smaller as the increase of the roll temperature and increases the flexibility, and when the roll temperature is increased, an oxide is vigorously included and the flexibility is lowered. This is due to the fact that the thus obtained thin ribbon is uneven and warped, particularly the thin ribbon obtained around at a room temperature is very uneven and warped, and as a result, the minimum laminatable diameter becomes large. This warp can sufficiently be corrected by a heat treatment of 500°-1,200° C. for about within 5 minutes, but the unevenness on the surface of the thin ribbon cannot be corrected.

EXAMPLE 6

A magnetic material consisting of 85.13 wt % of iron, 7.37 wt % of silicon and 5.50 wt % of aluminum and 0.007% of carbon and 0.004% of nitrogen as inevitable impurities and further containing 0.003% of oxygen and 0.005% of sulphur was molten and ejected on a rotating cooling substrate made of stainless steel having a diameter of 300 mmϕ rotated at 800 rpm and a thin ribbon having a thickness of 80 μm was formed. The magnetic property (Hc) and the workability of this thin ribbon are shown in Table 2.

TABLE 2

| Treatment of thin ribbon | Coercive force Hc (Oe) | Minimum radius of curvature | Shearing property |
|---|---|---|---|
| After super-rapid cooling | 1.0 | 7.0 | 0 |
| After sintering of 1,200° C. × 3 min. | 0.15 | 1.0 | 0 |
| Rolling and sintering of 1,000° C. × 3 min. | 0.13 | 1.0 | 0 |
| Heat treatment of 835° C. × 30 min. | 0.024 | 10.0 | 0 |

Note:
0 No shearing burr and excellent shearing property is shown.
Δ Some shearing burr but sufficient shearing can be done.
x Shearing is difficult.

In addition the magnetic property (Hc) shows a value when the thin ribbon was magnetized up to 9,000 G.

Further, said thin ribbon heat-treated at 835° C. for 30 minutes was formed into a magnetic head core by ultrasonic wave working, and its wear amount was measured by running a $CrO_2$ tape for 200 hours. The wear amount was 2 μm and its effective permeability at 10 KHz was 13,000, which are excellent characteristics as compared with the core manufactured from an ingot by a conventional method, which core wear amount is 2.8 μm and effective permeability is 3,000. The thin ribbon left as it was super-rapidly cooled was formed into a head core by a discharge working method and heat treated at 800° C. for 30 minutes. In this case, the same property was obtained as the above characteristics.

EXAMPLE 7

A raw material having the composition of silicon 9.5%, aluminum 5.5% and iron 85% in which a part of iron was substituted by Ti, Mn, Co, Ni, Mo, W, La, Sm, Dy, Yb, Cr, Zr, Ag and Au, the thus substituted material was molten and ejected on a drum-shaped rotating cooling substrate made of stainless steel having 300 mm in diameter rotated at 1,700 rpm and a thin ribbon having a thickness of 30 μm and a width of 3 mm was obtained. In this case, a cooling temperature of cooling substrate was 100° C. The thus obtained thin ribbon was annealed at a temperature of 800° C. for 1 hour in a vacuum, and its magnetic permeability (Hc) and Vickers hardness were measured. The results thereof are shown in Table 3.

TABLE 3

| Composition of thin ribbon | Coercive force Hc (mOe) | Vickers hardness (Hv) | Workability | Flexability |
|---|---|---|---|---|
| $Fe_{85}Si_{9.5}Al_{5.5}$ | 25 | 560 | o | o |
| $Fe_{82}Ti_3Si_{9.5}Al_{5.5}$ | 95 | 450 | o | o |
| $Fe_{84}Mn_1Si_{9.5}Al_{5.5}$ | 75 | 500 | o | o |
| $Fe_{83}Co_2Si_{10}Al_5$ | 80 | 480 | o | o |
| $Fe_{84.5}Ni_{0.5}Si_{9.5}Al_{5.5}$ | 75 | 450 | o | o |
| $Fe_{80}Co_5Si_{10}Al_5$ | 100 | 450 | o | o |
| $Fe_{83}Mo_2Si_{10}Al_5$ | 80 | 490 | o | o |
| $Fe_{80}W_5Si_{10}Al_5$ | 120 | 460 | o | o |
| $Fe_{80}La_5Si_{10}Al_5$ | 50 | 470 | o | o |
| $Fe_{83}Sm_2Si_9Al_6$ | 40 | 490 | o | o |
| $Fe_{84}Dy_1Si_{11}Al_4$ | 30 | 520 | o | o |
| $Fe_{80}Yb_5Si_{10}Al_5$ | 75 | 480 | o | o |
| $Fe_{78}Mo_5Co_2Si_9Al_6$ | 150 | 400 | o | o |
| $Fe_{75}Co_{10}Si_9Al_6$ | 180 | 400 | o | o |
| $Fe_{84}V_{0.5}Cr_{0.5}Si_9Al_6$ | 80 | 470 | o | o |
| $Fe_{82}Zr_1Ag_1Au_1Si_9Al_6$ | 100 | 490 | o | o |

Note:
o designates good properties.

What is claimed is:

1. A method of manufacturing a thin ribbon of magnetic material having a high permeability and excellent flexibility and workability comprising the steps of:

melting a magnetic material consisting essentially of by weight of 4–7% of aluminum, 8–11% of silicon and the remainder iron and inevitable impurities of less than 0.5%, at a temperature between the melting point and a temperature not exceeding about 300° C. above the melting point;

ejecting the resultant melt through a nozzle under a pressure of from about 0.01 to 1.5 atm. onto a moving surface of a cooling substrate; and cooling the melt on said moving surface of said cooling substrate at a cooling rate of from about $10^3$ to $10^{6}$° C./sec to form a thin ribbon having a compact and fine grain size structure, wherein the fine crystal grain structure is essentially composed of columnar grains aligned perpendicular to the surface of the thin ribbon and having a mean grain diameter of from about 1 to 100 μm.

2. A method as defined in claim 1, wherein the composition of said melt of thin ribbon material consists of by weight 4–7% of aluminum, 8–11% of silicon, and the remainder iron and inevitable impurities of less than 0.5% and at least one element of less than 7% by weight in total selected from the group consisting of vanadium, niobium, tantalum, chromium, molybdenum, tungsten, copper, titanium, manganese, germanium, zirconium, antimony, tin, beryllium, boron, bismuth, lead, yttrium and rare-earth metal.

3. A method as defined in claim 1, wherein the composition of said melt consists of by weight 4–7% of aluminum, 8–11% of silicon, and the remainder iron and inevitable impurities as main ingredients and at least one element selected from 0.01–2% of manganese, 0.01–10% of cobalt and 0.01–3% of nickel.

4. A method as defined in claim 1, wherein said cooling substrate is selected from drum-type, disc-type, twin roll type and belt conveyor type with or without backup roll.

5. A method as defined in claim 1, wherein the melt is ejected through a nozzle having a plurality of nozzle holes arranged adjacent to each other in the lateral direction of thin ribbon.

6. A method as defined in claim 1, wherein the melt is ejected through a nozzle cooled by water in the peripheral portion of nozzle hole and cooled super rapidly on the moving surface of cooling substrate.

7. A method as defined in claim 1, wherein said nozzle for ejecting melt is made of a heat resistant material selected from the group consisting of boron nitride, silicon nitride, silicon carbide, ceramics, fused silica, semi-fused alumina, magnesia, beryllium, platinum, platinum-rhodium, tungsten, molybdenum, tantalum, titanium and carbon, alloys thereof.

8. A method as defined in claim 9, wherein the nozzle is lined with boron nitride in at least the edge and inner edge portion of nozzle.

9. A method as defined in claim 1, wherein the cooling substrate is made of material selected from the group consisting of copper, copper-beryllium, brass, stainless steel and carbon steel.

10. A method as defined in claim 1, wherein the nozzle comprises a single nozzle hole or a plurality of nozzle holes selected from circular, elliptical and rectangular configurations.

11. A method of manufacturing a thin ribbon of magnetic material having high permeability and excellent flexibility and workability comprising the steps of:

melting a magnetic material consisting essentially of by weight 4–7% of aluminum, 8–11% of silicon and the remainder iron and impurities of less than about 0.5% at a temperature between the melting point and a temperature not exceeding 300° C. from the melting point and adjusting a viscosity of said melt to from about $5.5\times10^{-2}$ to $3\times10^{-2}$ dyne sec/cm$^2$;

ejecting the resultant melt through a nozzle under a pressure of from about 0.01 to 1.5 atm. onto a moving surface of a cooling substrate;

cooling the melt on the moving surface of said cooling substrate at a cooling rate of from about $10^3$ to $10^{6}$° C./sec to form a thin ribbon having a compact and fine grain size structure having a mean grain diameter of from about 1 to 100 μm and;

annealing the resulting thin ribbon at a temperature of between 600° to 1,000° C. for from about 1 minute to 5 hours, so as to obtain a column-like crystal structure having a grain size of from about 0.01–10 mm by promoting the growth of crystal grain size.

12. A method as defined in claim 11, wherein a rotating cooling substrate has a good wettability to the melt and the melt is cooled at a sufficient super-rapid cooling of $10^3$–$10^{6}$° C./sec during the instantaneous adhering and moving on the cooling substrate.

13. A method as defined in claim 11, wherein a melting temperature of the melt is suitably selected from the temperature range of between the melting point and a temperature not exceeding 300° C. from the melting point and the viscosity is adjusted with respect to the ejecting pressure of 0.01–1.5 atm so as to avoid forming a mist, small tablets or rattan blind, corrugated ribbon or periphery shredded ribbon.

14. A thin ribbon of magnetic material having a high permeability, excellent flexibility and workability consisting essentially of by weight 4–7% of aluminum, 8–11% of silicon and the remainder being iron and inevitable impurities and having a compact fine grain structure with a mean grain diameter from about 1 to 100 μm, wherein the fine crystal grains are essentially of columnar grain structure aligned perpendicular to the surface of the thin ribbon.

15. A thin ribbon of magnetic material having a compact fine grain crystal structure, a high permeability, excellent flexibility and workability, consisting essentially of by weight 4–7% of aluminum, 8–11% of silicon, at least one element selected from the group consisting of 0.01–2% of maganese, 0.01–10% of cobalt and 0.01–3% of nickel and the remainder being iron and inevitable impurities, wherein the compact fine grain crystal structure is composed essentially of columnar grains aligned perpendicular to the surface of the thin ribbon and has a mean grain diameter of from about 1 to 100 μm.

16. A thin ribbon of magnetic material having a high permeability as defined in claim 14, wherein said inevitable impurities are less than 1% in total of carbon, nitrogen oxygen and sulphur.

17. A magnetic recording and reproducing head comprising at least one thin ribbon of a magnetic material consisting essentially of by weight 4–7% of aluminum, 8–11% of silicon and the remainder being iron and inevitable impurities of less than 0.5% having a compact fine grain crystal structure, wherein the compact fine grain crystal structure is composed essentially of columnar grains aligned perpendicular to the surface of the thin ribbon and having a mean grain diameter of from about 1 to 100 μm.

18. A magnetic recording and reproducing head as defined in claim 23, wherein said thin ribbon is annealed at a temperature of 600°-1,000° C. from about 1 minute to 5 hours after forming a magnetic recording and reproducing head whereby said thin ribbon has an ordered lattice, more than 500 of Vickers hardness and a mean grain diameter of from about 1 to 100 μm.

19. A thin ribbon of magnetic material having a high permeability, excellent flexibility and workability consisting essentially of by weight 4-7% of aluminum, 8-11% of silicon and the remainder being iron and inevitable impurities and having a crystal grain structure with ordered lattice having a mean grain size of 0.01-10 mm, wherein the crystal grains are promoted to a columnar grain structure aligned perpendicular to the surface of the thin ribbon and having a grain size of from about 0.01-10 mm.

20. The method of claim 1 wherein the mean grain diameter is from about 1 to about 100 μm.

* * * * *